US007188644B2

(12) United States Patent
Kelly et al.

(10) Patent No.: US 7,188,644 B2
(45) Date of Patent: Mar. 13, 2007

(54) APPARATUS AND METHOD FOR MINIMIZING THE GENERATION OF PARTICLES IN ULTRAPURE LIQUIDS

(75) Inventors: Wayne Kelly, Lawrence, KS (US); Dennis Chilcote, Minneapolis, MN (US)

(73) Assignee: Advanced Technology Materials, Inc., Danbury, CT (US)

( * ) Notice: Subject to any disclaimer, the term of this patent is extended or adjusted under 35 U.S.C. 154(b) by 647 days.

(21) Appl. No.: 10/139,185

(22) Filed: May 3, 2002

(65) Prior Publication Data

US 2003/0205285 A1 Nov. 6, 2003

(51) Int. Cl.
*B65B 1/04* (2006.01)
*B65B 3/04* (2006.01)

(52) U.S. Cl. ..... 141/20; 141/2; 141/4; 141/374; 141/351

(58) Field of Classification Search ..... 141/2, 141/3, 4, 20, 24, 374, 351
See application file for complete search history.

(56) References Cited

U.S. PATENT DOCUMENTS 288,603 A 11/1883 Von Schliffen
3,371,822 A * 3/1968 Galloway ..... 222/95
3,802,470 A * 4/1974 Coleman ..... 141/5
4,756,347 A 7/1988 Hagen et al.
5,086,817 A * 2/1992 Murphy ..... 141/271
5,330,072 A * 7/1994 Ferri et al. ..... 222/1
5,343,901 A * 9/1994 Meshberg ..... 141/2
5,569,375 A 10/1996 Ridgeway
5,791,385 A * 8/1998 Stahlecker ..... 141/171
6,151,726 A 11/2000 Ajima
6,196,275 B1 * 3/2001 Yazawa et al. ..... 141/3
6,345,739 B1 * 2/2002 Mekata ..... 141/3
6,375,046 B1 * 4/2002 Alleard et al. ..... 141/3

OTHER PUBLICATIONS

U.S. Appl. No. 10/139,104, filed May 3, 2002, K. O'Dougherty, et al.
U.S. Appl. No. 10/139,186, filed May 3, 2002, R. Wertenberger.

* cited by examiner

*Primary Examiner*—Khoa D. Huynh
(74) *Attorney, Agent, or Firm*—Steven J. Hultquist; Intellectual Property/Technology Law; David Shofi

(57) ABSTRACT

A system and method of reducing particle generation in packaging containers used to transport ultra pure liquids. Particle generation in the containers is reduced by reducing the air-liquid interface present during filling, transport, and dispensing of the liquid.

45 Claims, 24 Drawing Sheets

DISPENSE

FILL

DISPENSE

FILL

APPARATUS AND METHOD FOR MINIMIZING THE GENERATION OF PARTICLES IN ULTRAPURE LIQUIDS

The disclosures of the following patent and published application co-filed on the same date as the filing date of the present application, are hereby incorporated herein by reference in their respective entireties: U.S. Pat. No. 6,698,619 of Richard Wertenberger, entitled "RETURNABLE AND REUSABLE. BAG-IN-DRUM FLUID STORAGE AND DISPENSING CONTAINER SYSTEM"; and U.S. Patent Application Publication No. US2003/0004608 A1 of Kevin T. O'Dougherty and Robert E. Andrews, entitled "LIQUID HANDLING SYSTEM WITH ELECTRONIC INFORMATION STORAGE."

BACKGROUND OF THE INVENTION

The present invention relates to minimizing the generation of particles in ultra pure liquids. In particular, the present invention relates to minimizing the generation of particles in ultra pure liquids during filling, dispensing, and transport of containers.

Numerous industries require that the number and size of particles in ultra pure liquids be controlled to ensure purity. In particular, because ultra pure liquids are used in many aspects of the microelectronic manufacturing process, semiconductor manufacturers have established strict particle concentration specifications for process chemicals and chemical-handling equipment. These specifications continue to become more stringent as manufacturing processes improve. Such specifications are needed, since if the fluids used during the manufacturing process contain high levels of particles, then the particles may be deposited on solid surfaces. This can in turn render the product deficient or even useless for its intended purpose.

A general philosophy behind the specifications is that if the fluid is clean, and the fluid handling component is also clean, the fluid passing through the component will remain clean. Alternatively, if a fluid container is clean, and the container is being filled with clean fluid, the fluid will remain clean during the filling process. A clean fluid in a clean container should still be clean upon delivery to the customer. Fluid handling components fresh from the manufacturing operation are often cleaned prior to packaging, and inherent in the cleaning operation is the assumption that the cleaning system itself does not contaminate the cleaning liquid. In contrast, it is also generally recognized that certain fluid handling components, like pumps, will continuously shed particles into the fluid that the pump is delivering.

However, it is not generally recognized that particles can appear in fluids to a greater or lesser degree depending upon the manner in which the fluid is passed through a component or is delivered to a container. For example, it has been discovered that if a clean container is partially filled with clean water, capped, and shaken vigorously, the particle concentration in the water will increase dramatically. New steps are required to ensure that particle concentrations in liquids are low enough to meet the stringent industrial specifications.

Thus, there is a need in the art for a system that minimizes particle generation in liquids during filling the containers, transporting the filled containers, and dispensing the liquids from the containers.

BRIEF SUMMARY OF THE INVENTION

The present invention relates to systems and methods of filling containers with ultra pure liquids in a manner that minimizes the amount of particles generated in the liquid. The presence of an air-liquid interface in the container has been shown to increase the particle concentration observed in the liquid. The present invention relates to systems and methods that minimize the air-liquid interface when filling, transporting, and dispensing liquids from containers.

A first method of reducing particle generation in an ultra pure liquid is to fill containers using a bottom fill method. The bottom fill method is achieved by utilizing a dip tube having a submerged tip from which the liquid enters the container. Submerging the tip of the dip tube below the surface of the liquid during filling of the container allows the liquid to enter the container with reduced splashing, turbulence, and entrainment of air. Avoiding splashing, turbulence, and entrainment of air ensures the air-liquid interface is minimized, and thus reduces the particles generated in the liquid.

A second method of reducing particle generation in an ultra pure liquid is to fill containers for the liquid, of the type including a liner and a rigid overpack, by first collapsing the liner, and filling the collapsed liner. Filling the container according to this method removes the air-liquid interface in the liner, and results in a filled container having no head-space air.

Other methods of reducing particle generation in an ultra pure liquid include submerging the nozzle in a system that uses a nozzle to either fill a container or as a cleaning jet. Submerging the nozzle below the surface of the liquid reduces the air-liquid interface and results in less particle generation.

In addition, in recirculation baths having a weir over which liquid can fall into a sump, particle generation can occur as the liquid falls into the sump, and causes splashing, bubbles, and turbulence. By reducing the overspill distance between the weir and the liquid in the sump, so that the liquid enters the sump with minimal splashing, reduced particle concentration in the liquid is achieved.

In siphoning systems, utilizing a smart siphon can also reduce particle concentrations. A smart siphon is one that is controlled to stop the siphoning action before the siphoning action is broken by entrainment of air and causes the remaining liquid in the siphon to fall back into the tank.

Finally, ensuring that any head space air is removed from the container before shipping reduces the particle concentration in the liquid in the container. In containers using liners, the head-space can be removed from the liner by pressurizing the container and venting out the head space air. In addition, in rigid containers, an inert bladder can be inserted to remove the head-space.

DETAILED DESCRIPTION

Figure 1:
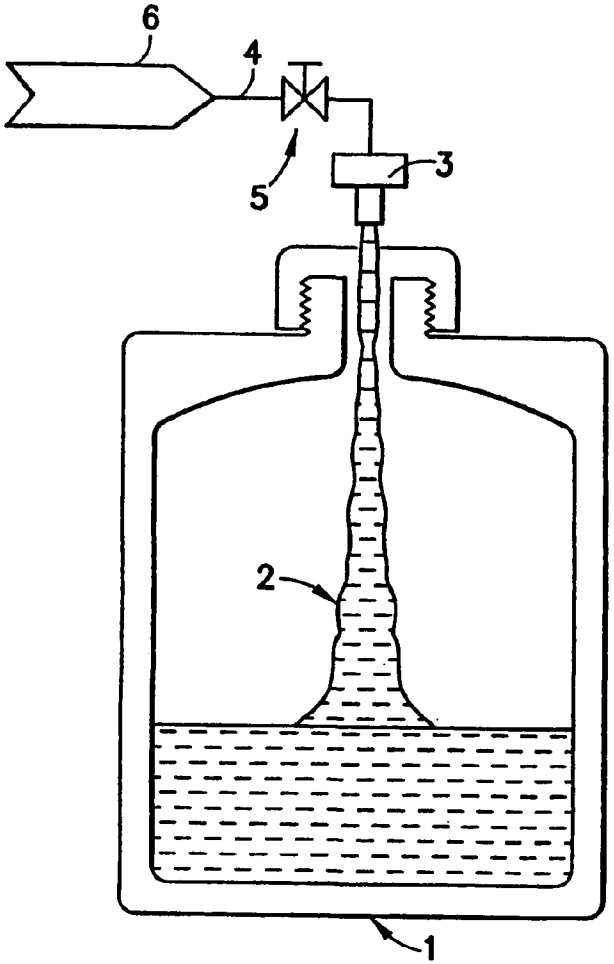
FIG.1 PRIOR ART
FIG. 1 (PRIOR ART) is an illustration of a standard top fill arrangement for filling a container with an ultra pure liquid.

FIG. 1 (PRIOR ART) is an illustration of a standard top fill arrangement for filling a container with an ultra pure liquid. Shown in FIG. 1 is a container 1, liquid 2, spigot 3, fill line 4, valve 5, and ultra pure liquid source 6. The valve 5 is located on the fill line 4 between the ultra pure liquid source 6 and the spigot 3. When the valve 5 is open, ultra pure liquid 2 enters the container 1 at the spigot 3. The spigot is located over an opening at the top of container 1.

As the ultra pure liquid exits the spigot 3, the liquid 2 falls freely into container 1 causing splashing, bubbling, and entrainment of air. The splashing, bubbling, and entrainment of air increase the surface area of the liquid, thus increasing an air-liquid interface of the liquid in the container. It has been found that filling a container in this manner causes significant particle generation in the liquid 2 stored in the container 1, resulting in increased particle concentration in the liquid 2.

BOTTOM FILL METHOD

Figure 2:
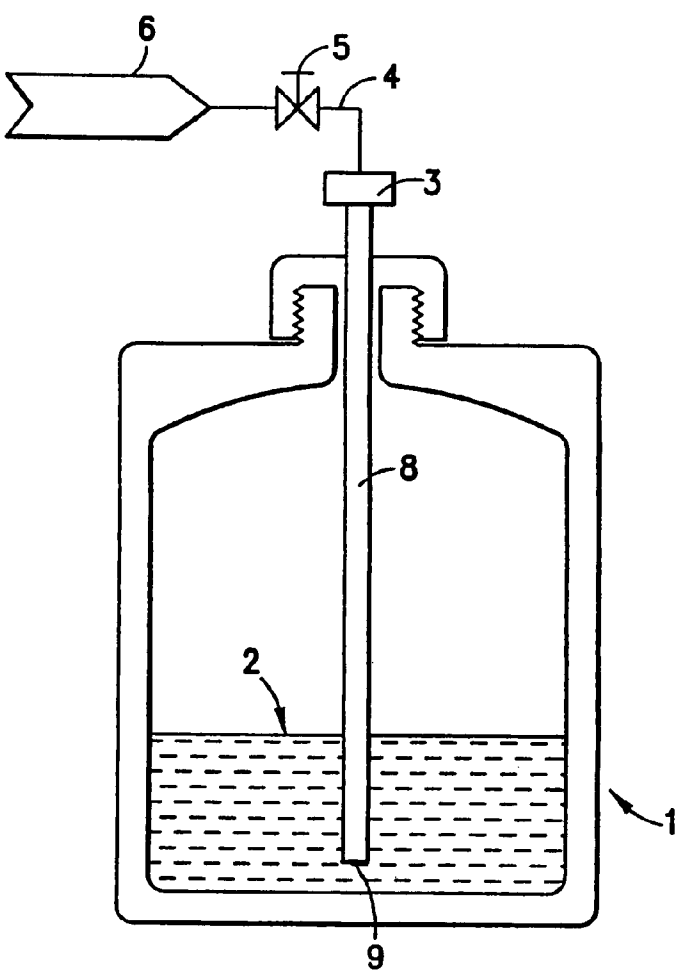
FIG. 2 is an illustration of a submerged tube bottom fill method for filling a container.

FIG. 2 illustrates a modification of the fill system of FIG. 1, which reduces the particle concentration in the liquid 2. Shown in FIG. 2 is a container 7 with spigot 3 connected to fill line 4, valve 5, and ultra pure liquid source 6, similar to the system of FIG. 1. However, unlike the system of FIG. 1, the fill system of FIG. 2 further comprises a fill tube 8 connected to the spigot 3. The fill tube 8 ends in a submerged tip 9 and extends downwardly in the interior volume of the container 7 so that the submerged tip 9 is positioned near the bottom of the container 7.

As the container 7 is filled, the submerged tip 9 is submerged under the surface of the liquid 2 during substantially the entire filling cycle, allowing the liquid flow from the tip 9 to remain contiguous under the liquid surface 2. As a result, the liquid exits submerged tip 9 without falling into the container 7. Rather, the introduction of liquid 2 into the container 1 is much more smooth, and causes much less splashing, bubbling, or turbulence.

Filling the container using fill tube 8 with a submerged tip 9 has been found to result in lower particle concentration in the liquid 7. In particular, when compared to the conventional top filling method in FIG. 1, the bottom filling method of FIG. 2 results in a much lower particle generation in the liquid 2. By submerging the tip 9 of the fill tube 8, the air-liquid interface is kept less turbulent, and the overall surface area of the liquid is decreased. This decreased air-liquid interface in turn retards particle shedding from container 7 and minimizes the particle concentration observed in the liquid.

COLLAPSE LINER FILL METHOD

Figure 3:
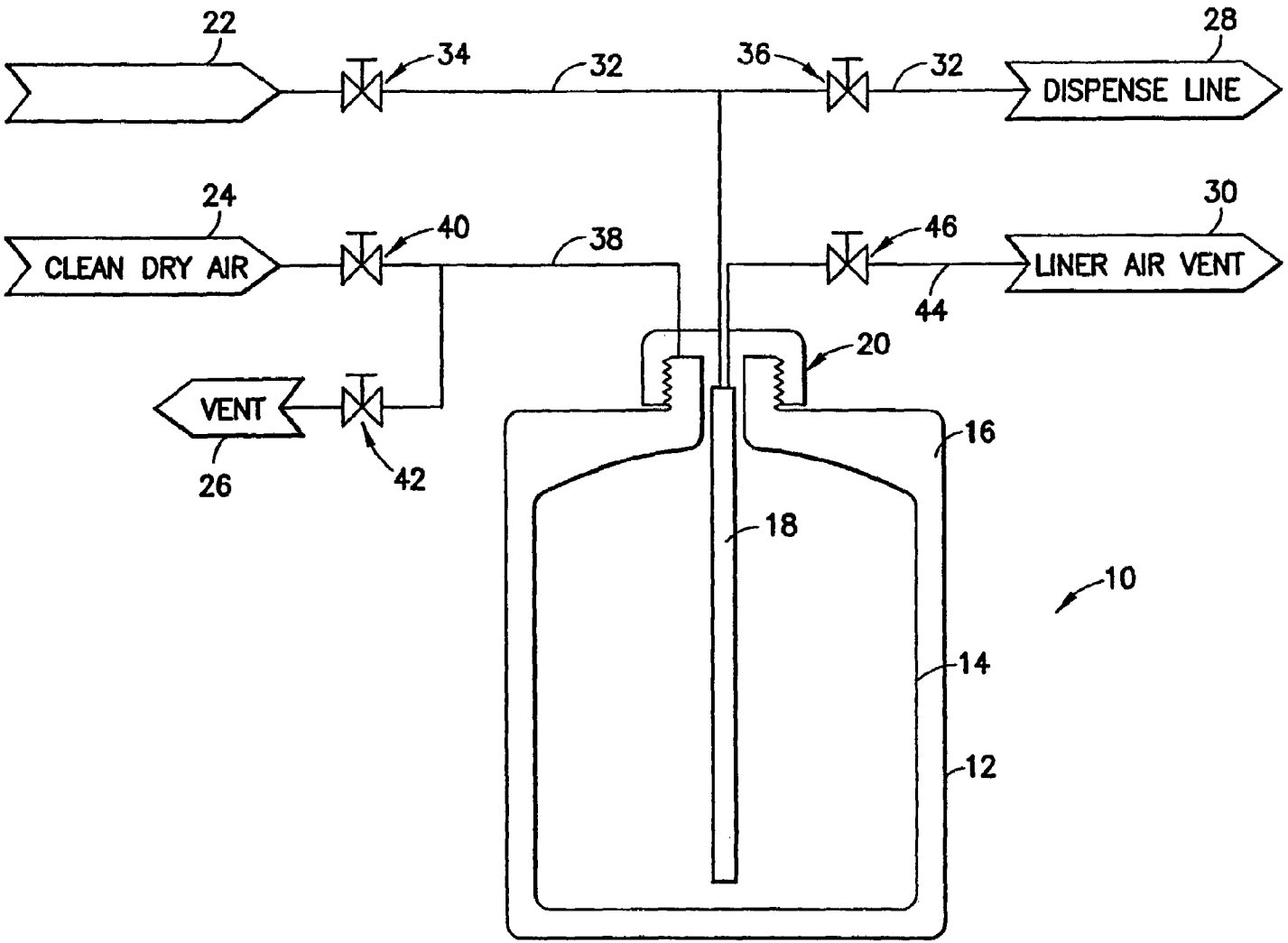
FIG. 3 is an illustration of a container having a collapsible liner.

FIG. 3 illustrates an alternative type of container used in packaging ultra pure liquids. The container 10 in FIG. 3 comprises a rigid outer container 12, a collapsible liner 14, an intermediate area 16, a dip tube 18, and a fitment 20. A standard method of filling the container 10 is to insert the liner 14 into the rigid outer container 12. The liner 14 is then inflated until the liner 14 presses against the outer container 12. Once the liner 14 is inflated, the container 10 can then be filled with liquid in a conventional manner.

This method of filling the container in FIG. 3 can be modified to minimize particle generation during filling. More particularly, the container 10 shown in FIG. 3 can be filled in a manner that greatly reduces the air-liquid interface during filling of the container.

Connected to the container 10 are an ultra pure liquid source 22, clean, dry air source 24, vent 26, dispense line 28, and liner air vent 30. A fluid fill and dispense line 32 connects the liquid source 22 to the inside of the liner 14 at the dip tube 18. The fill and dispense line 32 also connects to the dispense line 28. A fill valve 34 is located on the fill and dispense line 32 to allow fluid flow from the liquid source 22 to the liner 14. Similarly, a dispense valve 36 is located on the fill and dispense line 32 to allow fluid flow out of the container 10 to the dispense line 28.

An air supply line 38 connects the clean, dry air source 24 to the intermediate area 16 between the liner 14 and rigid container 12. Located on the air supply line 38 are an air inlet valve 40 and an air vent valve 42. The air inlet valve 40 controls the air flow from the air source 24 into the intermediate area 16. Similarly, the air vent valve 42 allows air in the intermediate area 16 to be vented from the container 10 to the vent 26.

An air vent line 44 connects the inside of the liner 14 to the liner air vent 30. A liner vent valve 46 is located on the air vent line 44 and allows air from inside the liner 14 to be vented to the liner air vent 30 via air vent line 44.

The fitment 20 connects to a top opening of the rigid container 12. The collapsible liner 14 is configured to be placed within the rigid container 12 and extend into the fitment 20. The dip tube 18 is disposed within the collapsible liner 14 and protrudes substantially to the bottom of the lined container 10. The dip tube 18 is also configured to extend into the fitment 20, and as described above is exposed to the fluid fill line 32. The intermediate area 16 is the area between collapsible liner 14 and rigid container 12 and varies in size depending on whether collapsible liner 14 is expanded or compressed.

The lined container 10 and the manner in which it is connected to lines 32, 38, and 44 allows the container 10 to be filled so as to minimize the air-liquid interface normally present when a rigid container is filled with liquid. Minimizing the air-liquid interface in turn results in minimizing any particle generation in the liquid.

This process of filling the container 10 begins with collapsing the liner 14. Starting with all valves 34, 36, 40, 42, and 46 closed, the liner 14 is collapsed by opening the air inlet valve 40 and the liner vent valve 46. Once opened, the air inlet valve 40 allows clean dry air from air source 24 to flow into intermediate area 16 via air supply line 38. The source 24 of the clean, dry air can be any suitably configured source, and is connected to the air supply line 38 in a conventional manner. This air flow increases pressure in intermediate area 16 and compresses collapsible liner 14. The liner vent valve 46 is also open so that as air is forced into the intermediate area 16 to collapse the liner 14, the air forced out of the inside of the liner 14 can exit the container 10 via air vent line 44 and be vented at the liner air vent 30. Once substantially all of the air has been vented from inside the liner 14 and it is suitably collapsed, the air inlet valve 40 and liner vent valve 46 are closed.

After collapsing the liner 14, the container 10 can be filled using the dip tube 18, which remains located inside the collapsed liner 14. To fill the container 14, the fill valve 34 is opened, as well as the air vent valve 42. Opening the fill valve 34 allows liquid to flow from the liquid source 22 into the collapsible liner 10 via the fill and dispense line 32. As lined container 10 is filled, collapsible liner 14 expands. Having the air vent valve 42 open allows the air in the intermediate area 16 to exit the container 10 at the vent 26 via line 38 as the liner 14 fills with fluid and expands.

As a result of removing most of the air from the collapsed liner 14, when liquid is introduced into the liner 14 via the dip tube 18, the air-liquid interface is greatly reduced, to thereby correspondingly reduce particle shedding from the container 10. Filling the container 10 using the collapse liner fill method has been shown to reduce the particle generation in the liquid, providing a purer liquid for industrial use.

The liquid in the lined container 10 can also be dispensed in a manner that minimizes particle generation. This is accomplished by opening the air inlet valve 40 to allow clean dry air to flow through the air supply line 38 into the intermediate area 16. The air flow increases pressure in the intermediate area 16 and can be used to compress the collapsible liner 14. As the collapsible liner 14 is compressed, the liquid contained within the collapsible liner 14 is forced out of the container 10 via the fill and dispense line 32 through the dispense valve 36 and to the dispense line 28. Dispensing the contents of the container 10 in this manner prevents the need for pumps, which continuously shed particles into the liquid that the pumps are delivering. In addition, this dispensing method reduces the air-liquid interface during dispensing, which has been shown to reduce particle generation in the liquid.

Though the collapsed liner fill method described above includes a dip tube through which liquid is introduced into the container using a bottom fill method, the same benefits can be achieved by using a top fill method that does not include a dip tube. The resulting particle concentrations achieved by using the collapsed liner fill method are much less than conventional fill methods. In particular, it has been demonstrated that a particle concentration less than 2 particles per milliliter for particles at 0.2 microns diameter is consistently realized by such collapsed liner fill method. In fact, the collapsed liner fill method in specific embodiments has achieved particle concentrations of less than 1 particle per milliliter for particles at 0.2 microns diameter. Current industry specifications require less than 50 particles per milliliter for particles at 0.2 microns diameter.

Although FIG. 3 has been described above as having air contained within collapsible liner 14, the present invention is not intended to be limited to air and collapsible liner may contain other gases, for instance nitrogen, argon, or any other suitable gas or combination of gases. The FIG. 3 container fill method has also been described as utilizing a clean dry air source 24. However, the present invention is not intended to be limited to clean dry air, and source 24 may supply any other suitable gas or combination of gases to the system, such as nitrogen, argon, etc. Further, though the above-described systems and those described hereinafter are discussed as using ultra pure water, other fluids in which the particle content is desired to be strictly controlled will benefit from this invention.

The extent to which the alternative fill methods illustrated by FIGS. 2 and 3 improve the particle count in the liquid is illustrated by the following experiments summarized in Table 1 below and described with reference to FIGS. 4A to 6D. Table 1 shows the results of filling containers according to four different methods, and then dispensing the contents of the container through an optical particle counter to measure the resulting concentration of particles in the liquid.

Figures 4A, 4B:
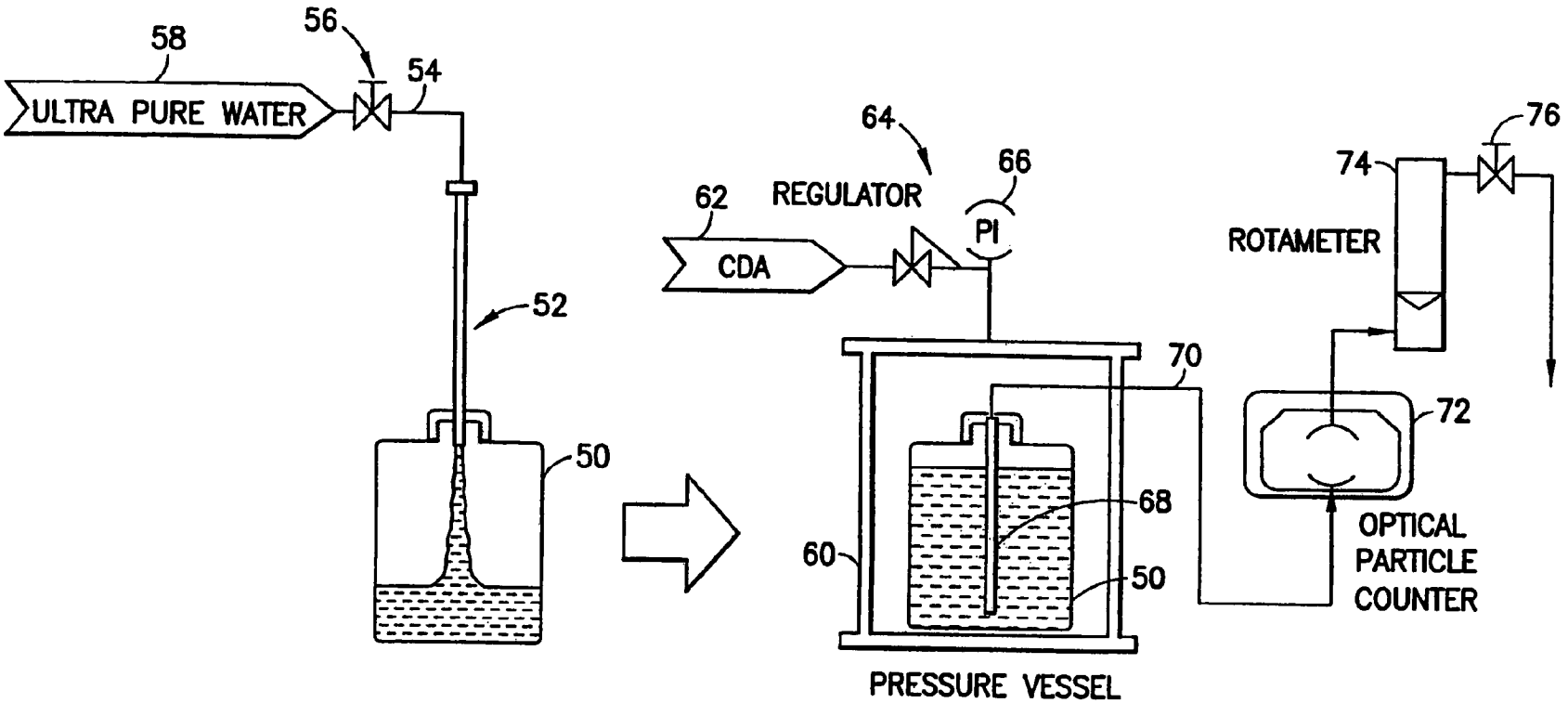
FIG.4A PRIOR ART
FIG. 4A (PRIOR ART) is an illustration of a standard top fill arrangement for filling a container.
FIG. 4B is an illustration of dispensing the contents of a container filled as illustrated in FIG. 4A so that the dispensed liquid is passed through an optical particle counter and rotometer.

The first fill method results in Table 1 are for top filling a container, inverting the container, and obtaining a resulting particle count. The fill and dispense method used to obtain this data is illustrated in FIGS. 4A and 4B. FIG. 4A (PRIOR ART) shows a container 50, fill tube 52, fill line 54, valve 56, and ultra pure water source 58. When the valve 56 is opened, ultra pure water from ultra pure water source 58 travels through fill line 54 to container 50. The ultra pure water enters the container 50 at the fill tube 52. Because the fill tube 52 is positioned above an opening in the container 50, as the ultra pure water enters the container, it falls from the top of the container to the bottom, causing splashing, bubbling, and entrainment of air.

FIG. 4B shows the manner in which the ultra pure water in the container 50 was subsequently dispensed. FIG. 4B shows the container 50 located in a pressure vessel 60. Connected to the pressure vessel 60 is a clean dry air source 62, a regulator valve 64, and a pressure indicator 66. In the container 50 is a dispense probe 68. The dispense probe 68 is connected to dispense line 70, along which is located a particle counter 72, rotometer 74, and valve 76. The contents of the container 50 can be dispensed by opening the valve 76 on the dispense line 70 and supplying the pressure vessel 60 with clean dry air. The clean dry air is supplied using the clean dry air source 62, valve 64, and pressure indicator 66 in the conventional manner.

As the ultra pure water is dispensed, it passes by the particle counter 72, which is configured to obtain a particle concentration of the liquid. One suitable particle counter is a Particle Measuring Systems M-100 optical particle counter. In addition, the rotometer 74 is configured to measure the flow rate at which the ultra pure water is being dispensed.

The system illustrated in FIGS. 4A and 4B was used to obtain the data for rows 1 and 2 of Table 1. In obtaining the data for row 1, ten containers were filled with ultra pure water to about 90% of fill capacity according the method illustrated in FIG. 4A. When the desired fill level was reached for each container, each container was capped and slowly inverted once to mix. The cap on the container was then replaced with a dispense probe and the container was placed in a pressure vessel for dispensing, as illustrated in FIG. 4B. Each container was dispensed at 300 ml/minute through the particle counter.

The data for row 2 were obtained in a similar manner. Ten containers were filled to about 90% capacity. However, instead of simply inverting the containers once to mix, the containers were shaken on an orbital shaker at 180 rpm for 10 minutes to simulate transport conditions. The containers were then dispensed as illustrated in FIG. 4B.

Figure 5B:
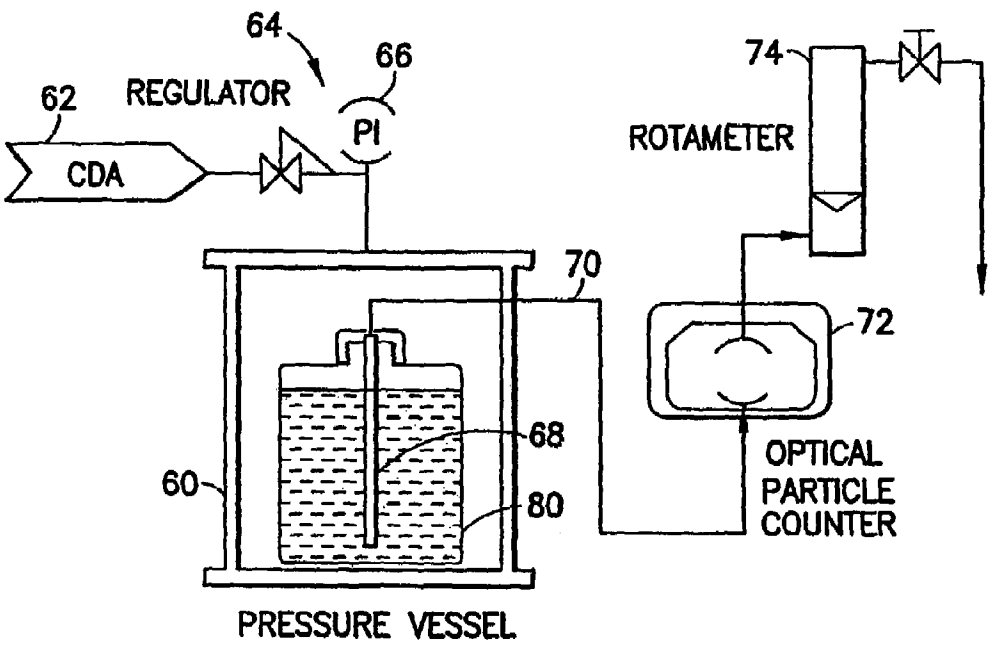
FIG. 5B is an illustration of dispensing the contents of a container filled as illustrated in FIG. 5A so that the dispensed liquid is passed through an optical particle counter and rotometer.
Figure 5A:
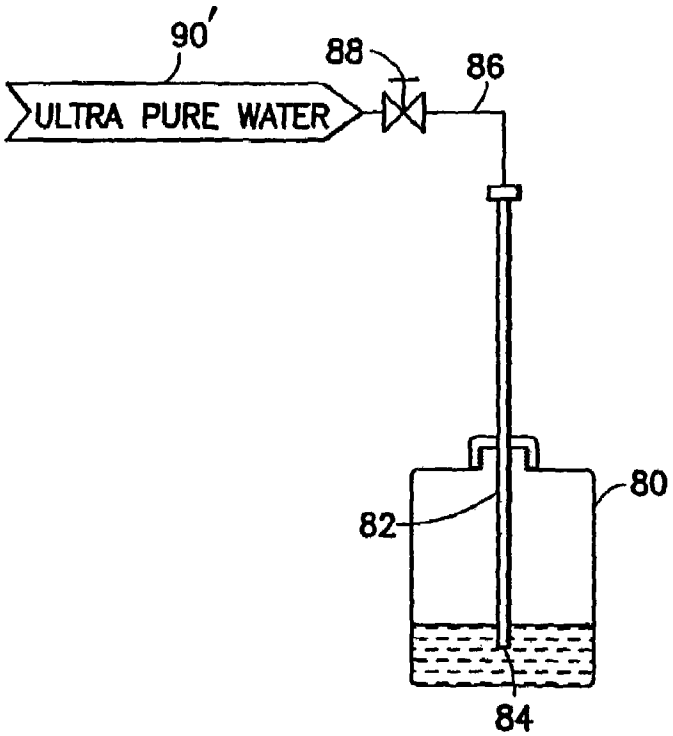
FIG. 5A is an illustration of a submerged tube bottom fill method for filling a container.

A third method of filling a container summarized in Table 1 is illustrated in FIGS. 5A and 5B. The system shown in FIG. 5A comprises a container 80, dip tube 82, submerged tip 84, fill line 86, valve 88, and ultra pure water source 90'. Dip tube 82 extends into container 80 and terminates at submerged tip 84. As the container 80 is filled, the ultra pure water enters the container 80 via the submerged tip 84. As a result, when the water exits submerged tip 84, the water enters the container 80 more smoothly and with less splashing, bubbling, and turbulence than the top filling method illustrated in FIG. 4A.

FIG. 5B shows the manner in which the ultra pure water is then dispensed from the container 80. The manner is identical to that described above with reference to FIG. 4B. Thus, a pressure vessel 60 was used to dispense the ultra pure water past a particle counter and rotometer, which allowed for a particle concentration of the water to be determined. Row 3 of Table 1 summarizes the results of filling ten containers according to the method illustrated in FIG. 5A, and dispensing them according to the method illustrated in FIG. 5B.

FIGS. 6A–6D illustrate the fourth container fill method tested to obtain data for Table 1. FIGS. 6A–6D illustrate the process of filling and dispensing containers having a collapsible lining using the same container and flow circuitry described above with reference to FIG. 3. However, unlike the system illustrated in FIG. 3, the system shown in FIGS. 6A–6D has in addition an optical particle counter 90 and rotometer 92 located on the fill and dispense line 32. The optical particle counter 90 and rotometer 92 are used to obtain a particle concentration of the ultra pure water as it is dispensed from the container 10.

Figure 6A:
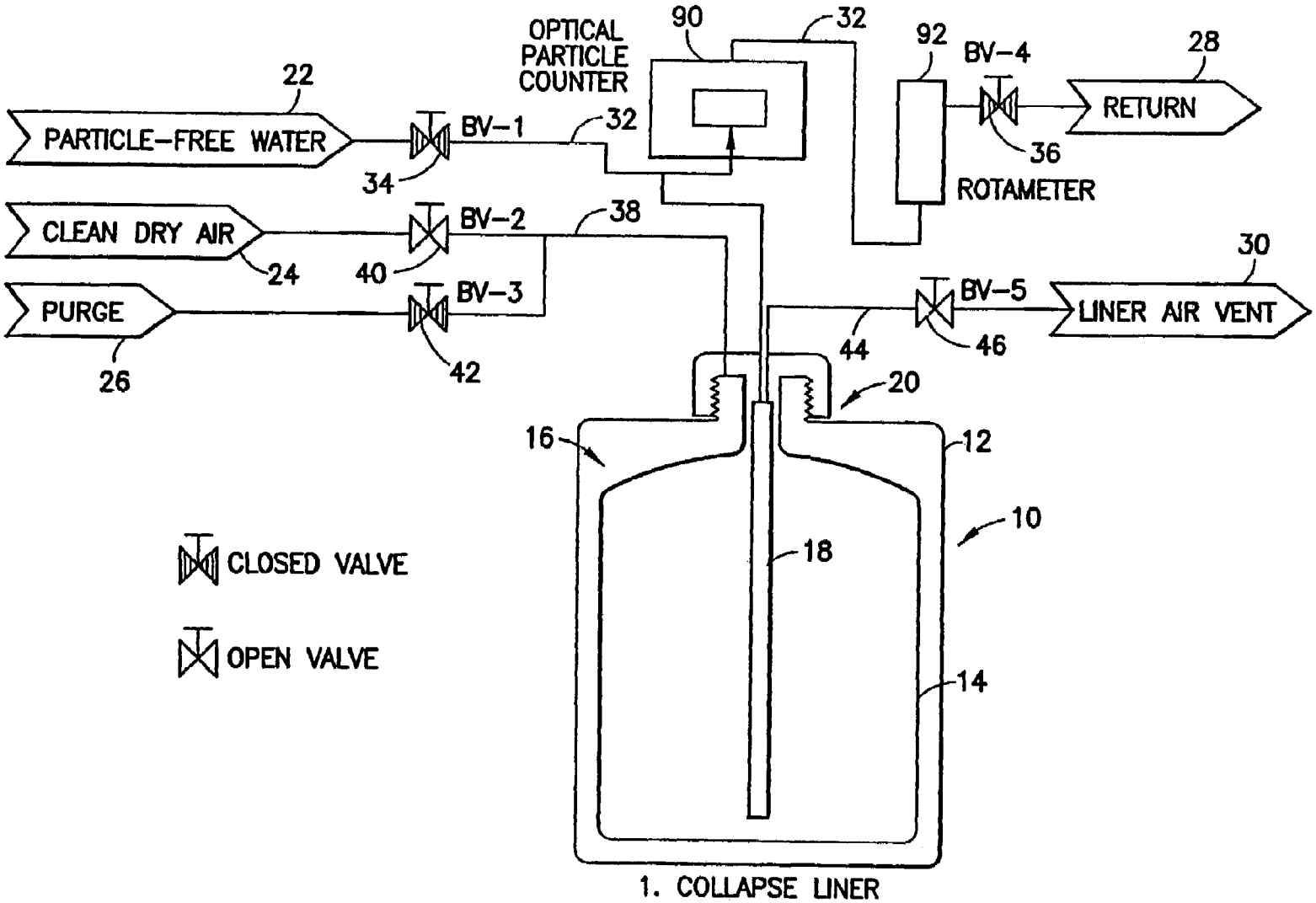
FIGS. 6A–6D are illustrations of a method of filling a container having a collapsible liner, and then dispensing the liquid from the container.

The method used to fill and dispense the containers began as shown in FIG. 6A. In FIG. 6A, the initial step of collapsing collapsible liner 14 is effected by opening air inlet valve 40 and liner vent valve 46, while keeping the other valves 34, 36, and 42 closed. Opening the inlet valve 40 and liner vent valve 46 collapses liner 14 by allowing clean dry air from clean dry air source 24 into the intermediate area 16 via line 38. At the same time the intermediate area 16 is being pressurized, the air in the liner 14 is forced out through the liner vent valve 46 to liner air vent 30. This causes the liner 14 to collapse around the dip tube 18.

Figure 6B:
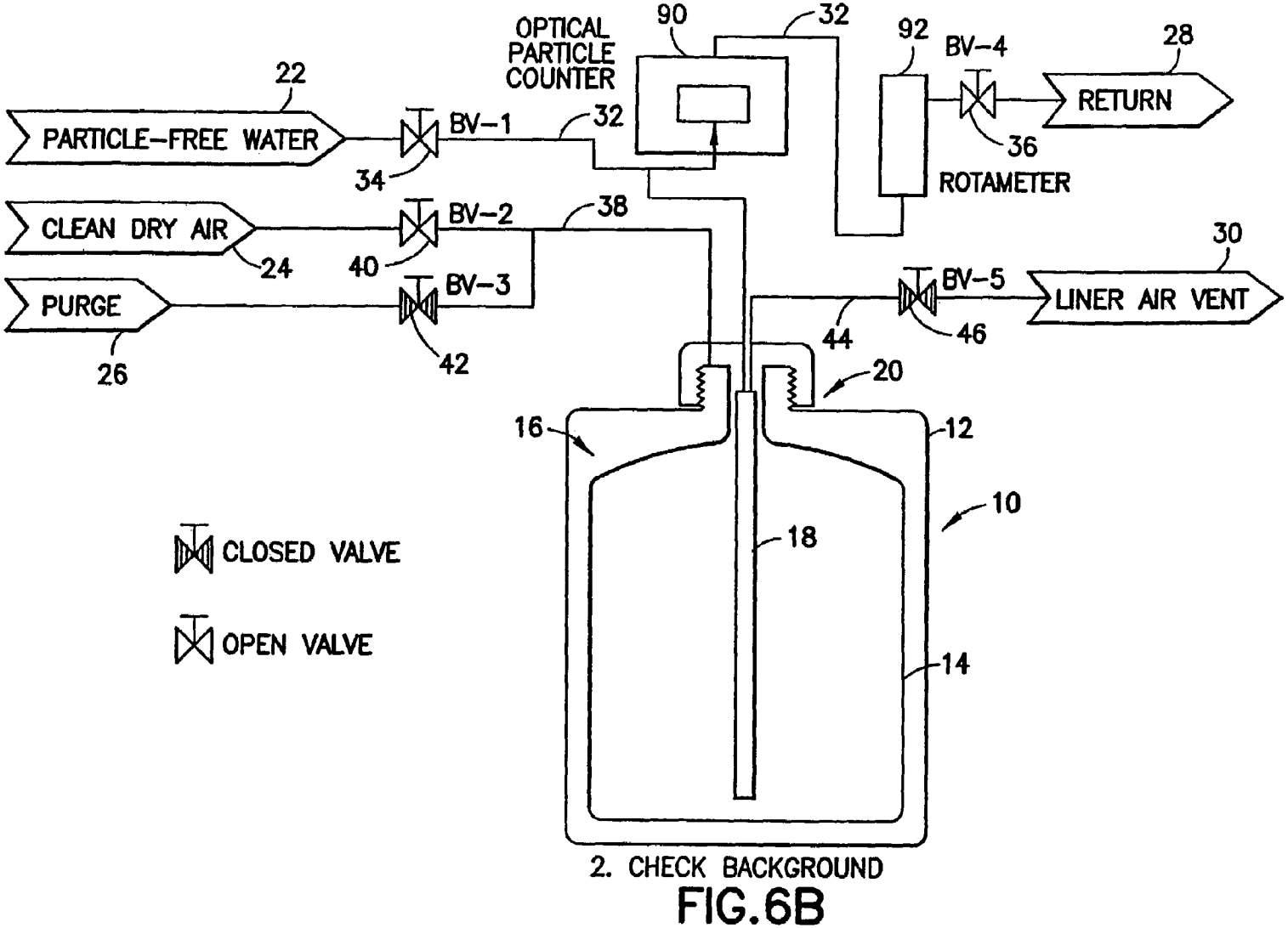

FIG. 6B illustrates an optional next step of measuring a baseline number of particles in the ultra pure water flowing through line 32. To obtain the baseline sample, the liner vent valve 46 is closed, and fill valve 34 and dispense valve 36 are both opened, as well as the air inlet valve 40. Opened valves 34 and 36 allow the water to flow from the source 22 through the fill and dispense line 32 directly to the particle counter 90 and rotometer 92 and out through the dispense line 28. The opened air inlet valve 40 allows air from the clean dry air source 24 in to the air supply line 38, to keep the liner 14 collapsed and prevent any of the water from source 22 from entering the liner 14.

Once the baseline particle concentration in the water is obtained, the baseline can then be compared to the particle concentration of the water in lined container 10 after the container has been filled. This step also provides the benefit of filling dip tube 18 with water, thereby removing any entrained air that may be present in the tube 18.

Figure 6C:
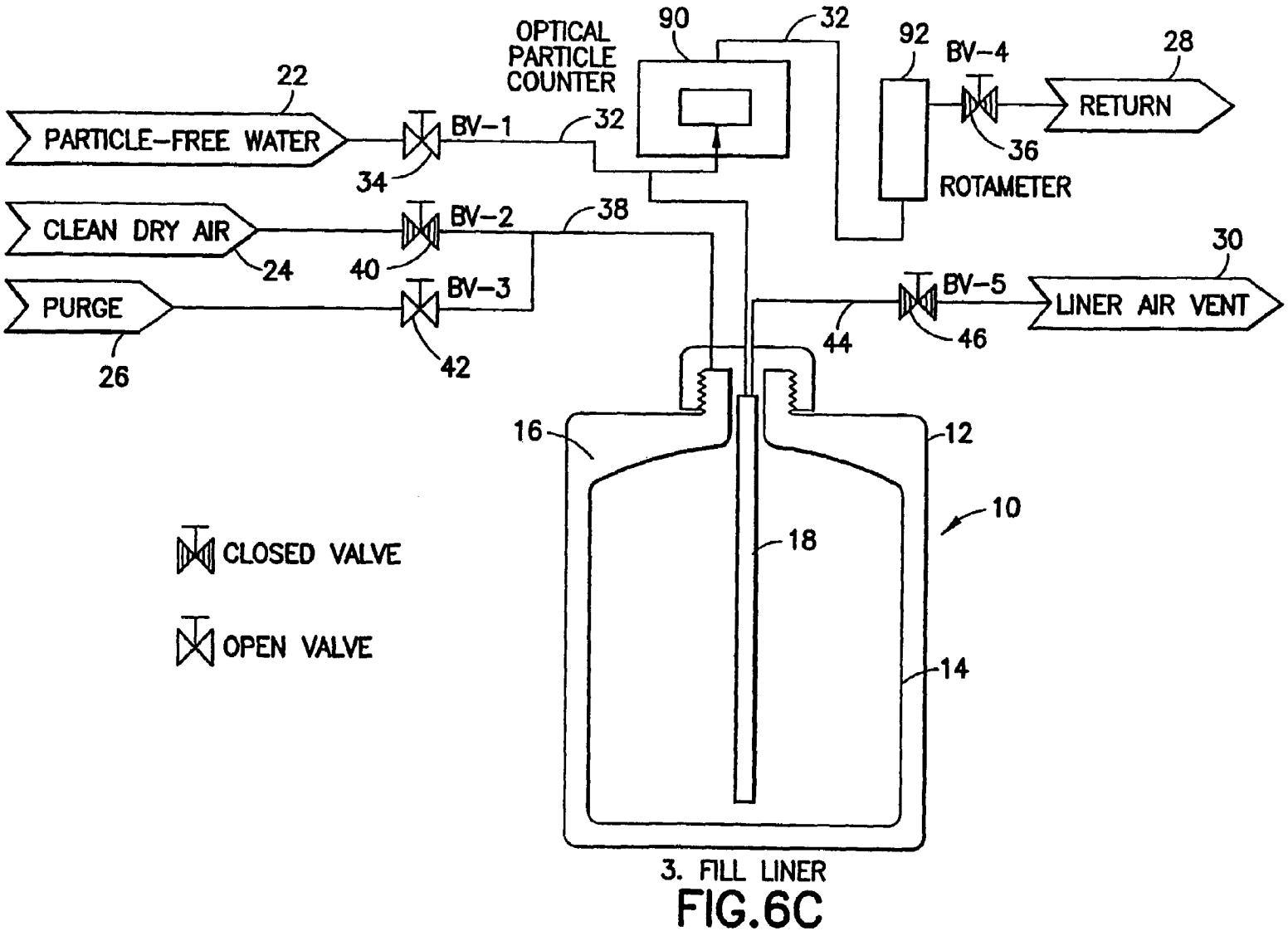

FIG. 6C illustrates the step of filling the container 10 by introducing water into the collapsed liner 14. To begin filling the container 10, the fill valve 34 and air vent valve 42 are opened, while all other valves, 36, 40, 46 are closed. The opened fill valve 34 allows water from the water source 22 to enter the fill and dispense line 32 and begin filling the liner 14 via dip tube 18. As the water enters collapsible liner 14, collapsible liner 14 expands, forcing air out of intermediate area 16. Opened air vent valve 42 allows the air in intermediate area 16 to vent out through line 38 as collapsible liner 14 expands. The fill process continues until collapsible liner 14 is filled to a desired level. Once full, the fill valve 34 is closed.

Figure 6D:
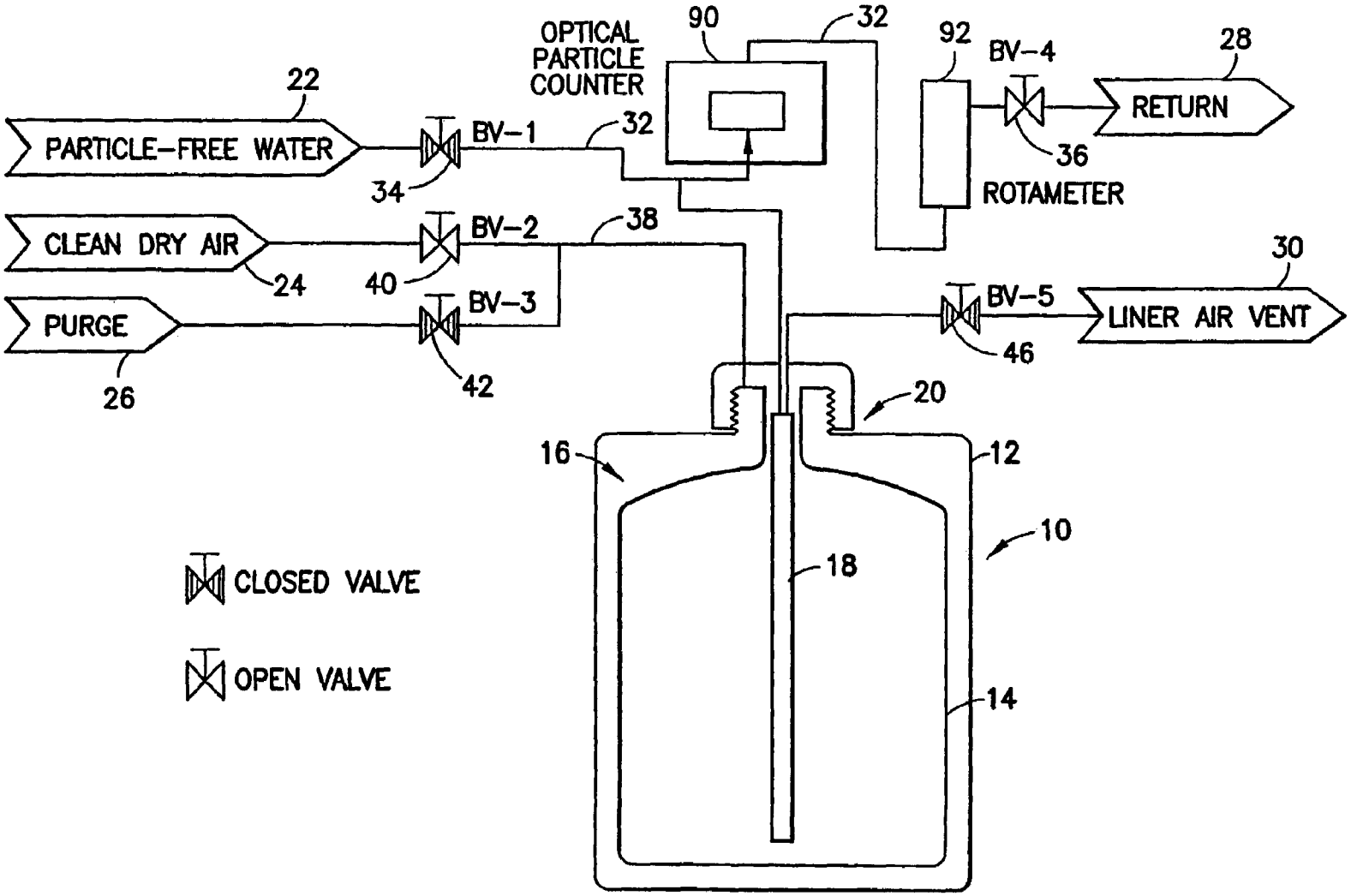

FIG. 6D illustrates the final step of dispensing the liquid from the lined container 10. To dispense the water, the dispense valve 36 and air inlet valve 40 are opened, while the other valves 34, 42, 46 are closed. Opening the air inlet valve 40 allows air to flow from air source 24 into the intermediate area 16. The air creates pressure on the collapsible liner 14, which compresses collapsible liner 14 and forces the water out of the collapsible liner 14. The liquid exits the liner 14 at the dip tube 18 and flows through the dispense line 32. As the water passes through the dispense line 32, the particle concentration is measured by the optical particle counter 90, and the flow rate is measured by the rotometer 92. Air is forced into the intermediate area 16 until the desired amount (typically all) of the water is removed from within collapsible liner 14. Dispensing the water in this manner precludes the need for pumps, which are known to shed particles.

Table 1 below summarizes the data collected from the four experiments described above. The table contains averaged results of the four experiments. As can be seen from the data, the highest concentration of particles resulted from top filling the container and shaking. In addition, it can be seen that the bottom fill method, and in particular the fill method involving first collapsing the liner and then filling the collapsed liner (the "collapsed liner fill method") resulted in significantly lower particle concentrations in the liquid.

TABLE 1

| Average particle size | Concentration of Particles (#/ml) 0.10 μm | 0.15 μm | 0.20 μm | 0.30 μm |
|---|---|---|---|---|
| Top Fill/Invert | 124 | 44 | 12 | 1.2 |
| Top Fill/Shake | 10151 | 4820 | 2066 | 181 |
| Bottom Fill | 29 | 11 | 4.0 | .085 |
| Collapse Liner Fill | 5.2 | 2.5 | 1.3 | 0.52 |

The data in Table 1 show that the presence of an air-liquid interface in a container affects the generation of particles in the liquid. Specifically, the results summarized in Table 1 show that when an air-liquid interface was not present during filling, such as during the collapsed liner fill method, the particle generation was virtually non-existent. When an air-liquid interface was present, as it was in the other three fill methods, particle generation was observed.

Though discussed in terms of an air-liquid interface, similar results have been obtained for other interfaces, including containers in which a vacuum exists over the liquid surface. Thus, the term air-liquid interface is used in the broadest sense to cover any liquid interface, including air, other gases or combinations of gases, or even a vacuum, in contact with the liquid surface.

Two further experiments involving the collapsed liner fill method were conducted. The experiments also showed that the method of dispensing the contents of the container has an effect on the resulting particle generation. Table 2 below compares the results obtained by collapse filling a container according to the method described with reference to FIG. 3 above, and then dispensing the contents, in two different ways.

The first manner of dispensing involved pouring the contents of the collapsed liner filled container (Container A) into a second container (Container B). As illustrated by the data in Table 1 above, filling Container A using the collapsed liner fill method resulted in the water in Container A having a very low concentration of particles. The water from Container A was then poured into an identical container, Container B. Container B was capped with a standard dispense probe and dispensed through a particle counter. As is shown in Table 2 below, the concentration of particles in the water increased dramatically after it was poured into Container B.

Figure 7A:
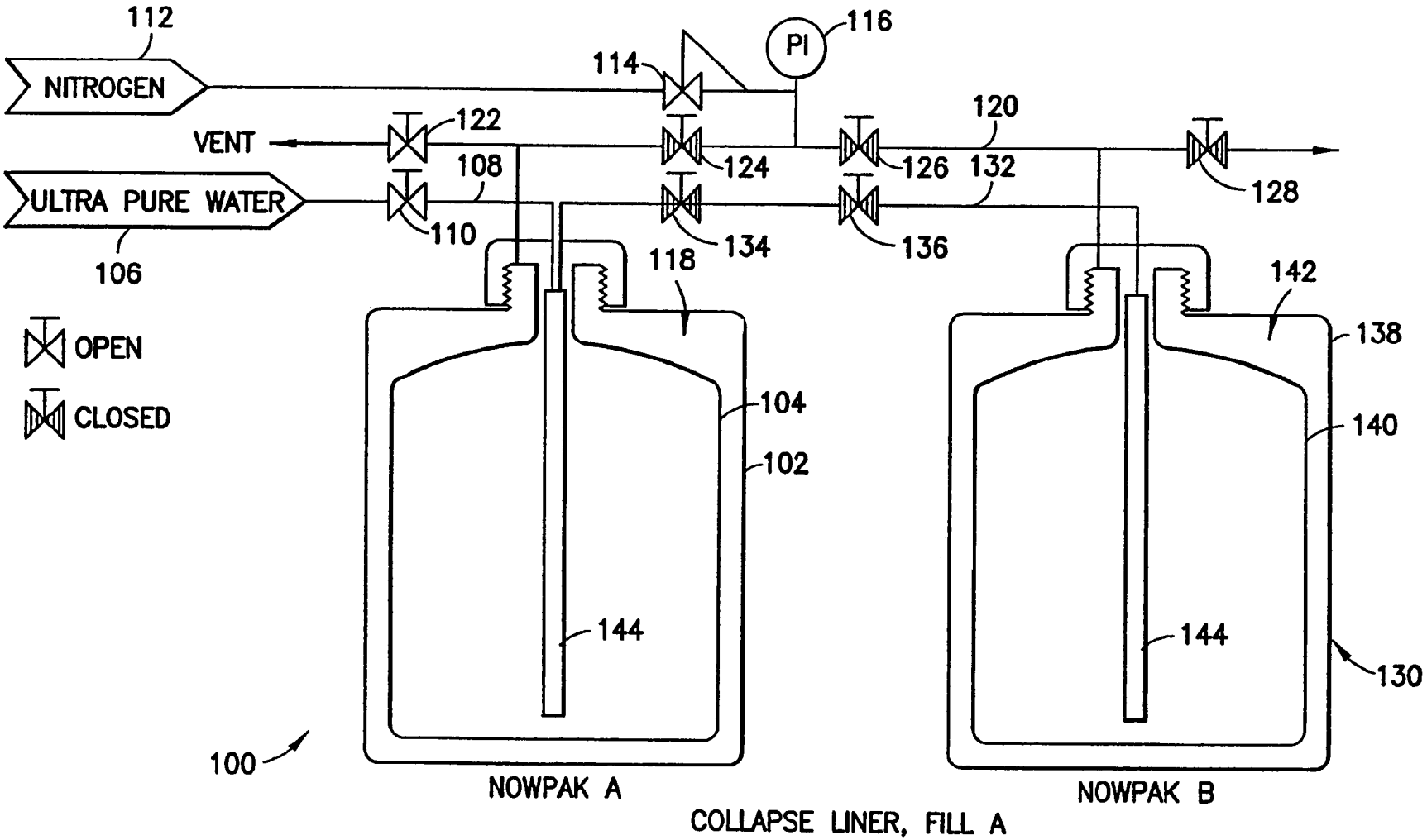
FIGS. 7A–7C are illustrations of a method of filling a first container, dispensing the contents of the first container to a second container, and dispensing the contents from the second container through an optical particle counter and rotometer.
Figure 7B:
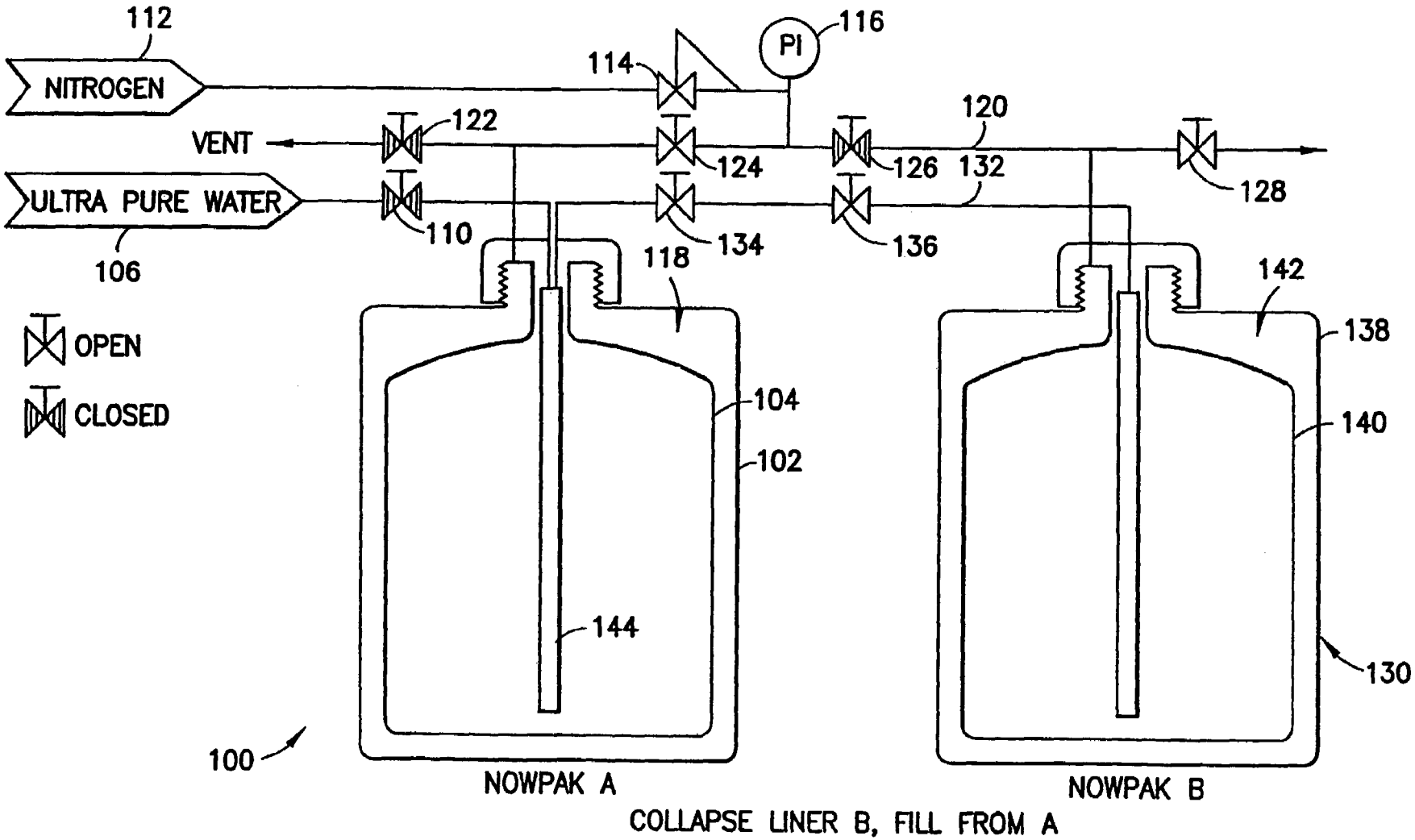

The second method of dispensing used is illustrated by FIGS. 7A–7B. The second method involved collapse liner filling the first container, Container A, and then collapsed liner filling the second container, Container B, from Container A. FIG. 7A shows the first step in the process, that of filling Container A using the collapsed liner fill method. Similar to the container and flow circuitry illustrated in FIG. 3, FIGS. 7A–C show a lined container 100 having a rigid outer container 102 and an inner lining 104. The inner lining 104 is connected to ultra pure water source 106 via line 108. A fill valve 110 controls the passage of liquid from the source 106 to the container 100.

Also shown connected to the first container 100 is a nitrogen source 112, nitrogen inlet valve 114, and pressure indicator 116. The nitrogen source 112 is connected to the intermediate area 118 via nitrogen supply line 120. Located on the nitrogen supply line 120 are four valves 122–128. The two outer valves 122, 128 allow for nitrogen in the line 120 to vent. The two inner valves, 124, 126 control the flow of nitrogen so that it can selectively be directed to either the first container 100 or a second container 130. The second container 130 is connected to the first container 100 by dispense line 132. Located along dispense line are two valves 134, 136.

Similar to the first lined container 100, the second lined container 132 comprises a rigid container 138 and collapsible liner 140. An intermediate area 142 between the rigid container 138 and collapsible liner 140 is also connected to the nitrogen source by line 120. Both the first container 100 and the second container 130 have dip tubes 144 disposed within their respective collapsible liners 104, 140.

Figure 7C:
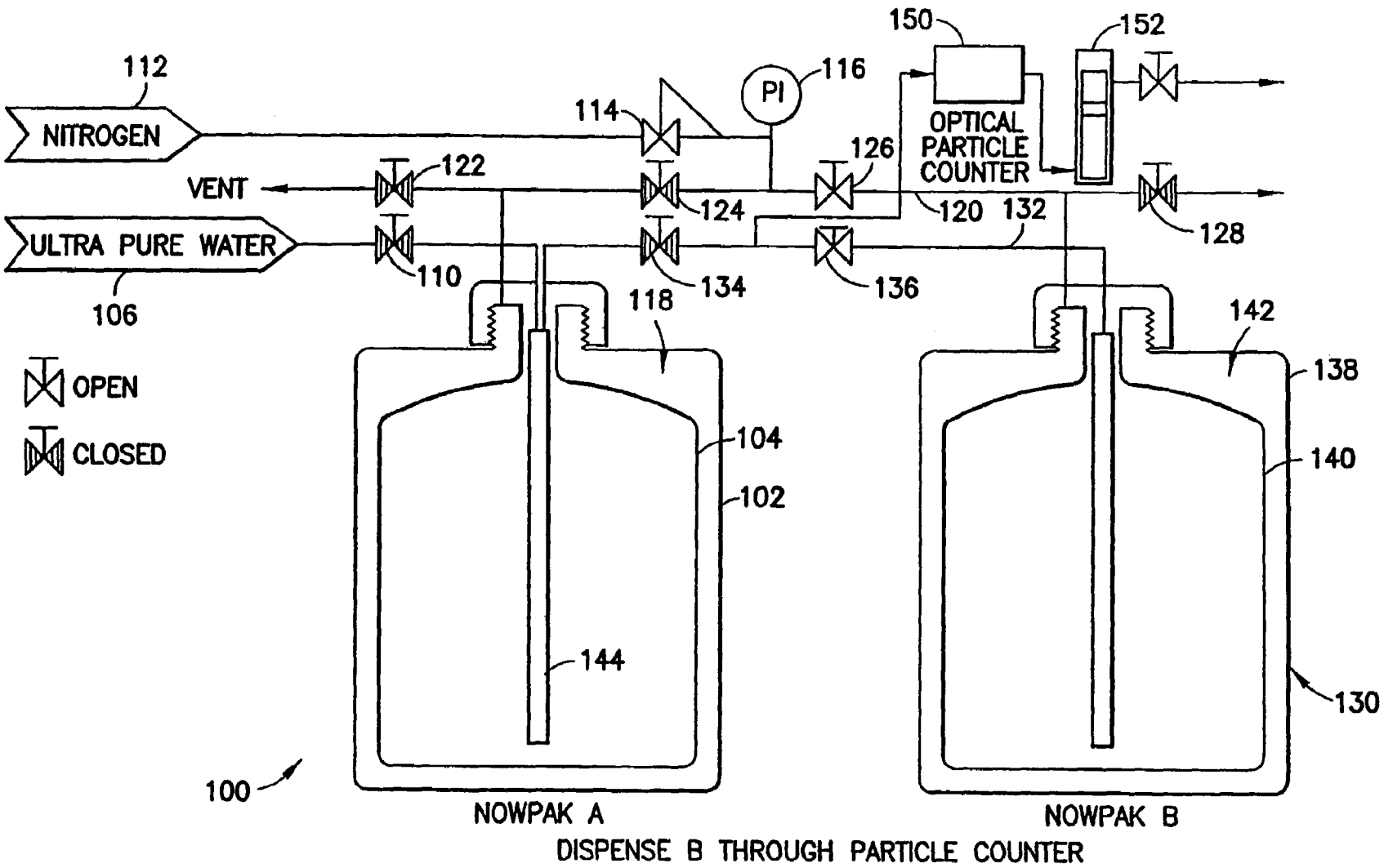

In FIG. 7C, a particle counter 150 and rotometer 152 are located along the dispense line 132 between the valves 134, 136. Locating the particle counter 150 and rotometer 152 between the valves 134, 136 allows for the contents of the second container 130 to be dispensed past the particle counter 150 and rotometer 152 so that data regarding particle concentration can be collected.

FIG. 7A illustrates the first step of collapsing the liner of the first container 100, and filling the container according to the method described above with reference to FIG. 3. Next, as shown in FIG. 7B, the liner 140 of the second container 130 was collapsed. Once the liner 140 of the second container 130 was collapsed, the contents of the first container 100 were dispensed into the second container 130. Thus, the second container 130 was also filled using the collapsed liner fill method. However, instead of being filled with water from a water source, the second container 130 was filled with the water from the first container 100. This method allowed for filling the second container 130 in a manner that minimized the air-liquid interface.

After the second container 130 was filled, the liquid was dispensed from the second container via dispense line 120, as shown by FIG. 7C. The water flowing through dispense line 120 flowed through optical particle counter 150 so that the particle concentration in the water could be determined. The water also flowed through the rotometer 152 to determine the water flow rate.

Table 2 below shows the resulting particle concentration in the ultra pure water subjected to both methods of dispensing described above. As the data illustrate, a rather high particle generation can result from simply pouring water from one container to another.

TABLE 2

| Average particle size | Concentration of Particles (#/ml) 0.10 μm | 0.15 μm | 0.20 μm | 0.30 μm |
|---|---|---|---|---|
| Collapse fill A, pour A into B, dispense B | 1070 | 433 | 127 | 50 |
| Collapse fill A, collapse fill B from A, dispense B | 25.1 | 9.94 | 3.02 | 1.85 |

In a similar experiment, the same two dispensing methods were duplicated using a standard HDPE reagent bottle. In these experiments, the first container 100 was replaced with the HDPE bottle. The results for this experiment are summarized in Table 3 below.

In Table 3, the first row gives the particle concentration for a HDPE reagent bottle filled via a submerged dip tube, according to the method described above with reference to FIG. 2. The submerged dip tube fill and dispense method was used to obtain baseline data to which the remaining two fill and dispense methods could be compared. The second row of Table 3 shows the results of simply pouring the contents of the HDPE reagent bottle into a second container (Container B). The last row of Table 3 contains data from a fill and dispense procedure in which the HDPE reagent bottle was filled using a submerged dip tube, and the second container (Container B) was collapse filled from the HDPE reagent bottle using a method similar to that described above in reference to FIG. 7B.

TABLE 3

| | Concentration of Particles (#/ml) | | | |
|---|---|---|---|---|
| Average particle size | 0.10 μm | 0.15 μm | 0.20 μm | 0.30 μm |
| HDPE bottle, fill via submerged dip tube, dispense (baseline data) | 290 | 138 | 64.6 | 27.6 |
| Pour from HDPE to B, dispense B | 4700 | 1930 | 797 | 178 |
| Collapse fill B from HDPE, dispense B | 305 | 145 | 75.7 | 30.6 |

As shown in Table 3, a significant number of particles were generated in filling the HDPE bottle with a submerged dip tube. Yet, as can be seen from comparing the first and third rows of Table 3, virtually no particles were subsequently generated in dispensing from the HDPE bottle to the collapsed liner container using the collapse fill method. Again it can be observed that when liquid is poured from one container to another in the typical fashion in which an air-liquid interface is present, significant particle generation is observed. When the liquid transfer takes place in such a way that the air-liquid interface is reduced, the particle generation is likewise reduced.

Yet another experiment performed to determine the effect of various methods of dispensing liquid from a container and the resulting particle concentration in the liquid is summarized in Table 4 below. To obtain the data for Table 4, a standard 4-liter rigid HDPE reagent bottle was filled with three liters of ultra pure water using a submerged dip tube method, similar to that described above in connection with FIG. 2. In the first test, the bottle was pressurized and the water in the bottle was dispensed via the dip tube directly through an optical particle counter. In the second test, the bottle was shaken for one minute prior to dispensing the water through the optical particle counter. The particle concentrations in the water exiting the bottle are shown in Table 4.

TABLE 4

| | Concentration of Particles (#/ml) | | | |
|---|---|---|---|---|
| Average particle size | 0.10 μm | 0.15 μm | 0.20 μm | 0.30 μm |
| Fill and Dispense | 290 | 138 | 64.6 | 27.6 |
| Fill, Shake, and Dispense | 15900 | 7370 | 3180 | 739 |

The data of Table 4 show that the effect of an air-liquid interface on particle shedding is common to polymeric containers in general. The length of time between shaking the container and measuring the particle concentration in the liquid did not appear to affect the measurement.

SUBMERGED DISCHARGE NOZZLE

Figure 8B:
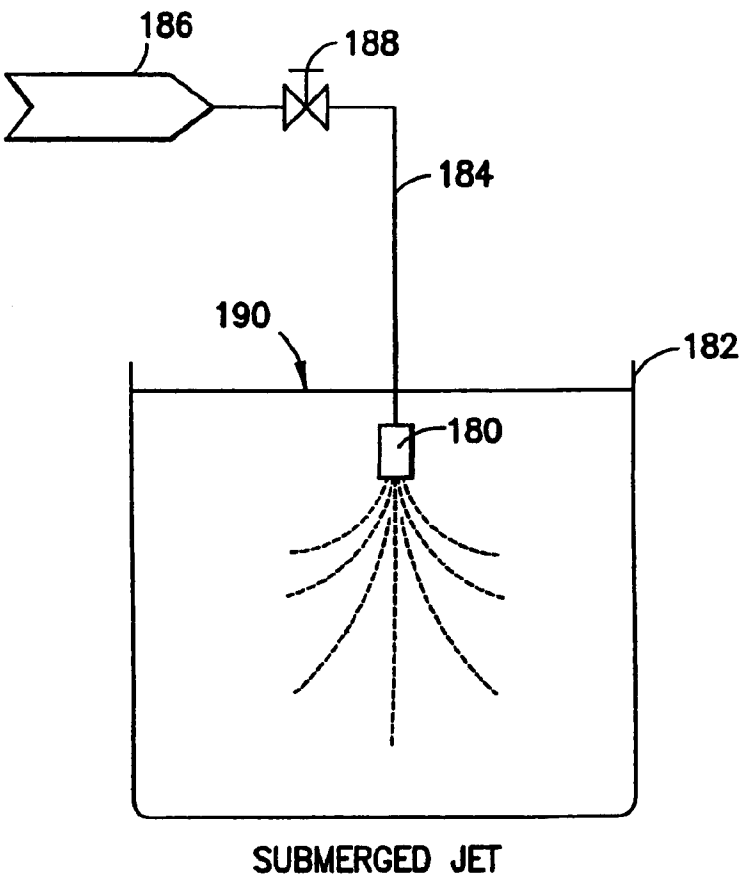
FIG. 8B is an illustration of a method of filling a container by submerging the fill nozzle.
Figure 8A:
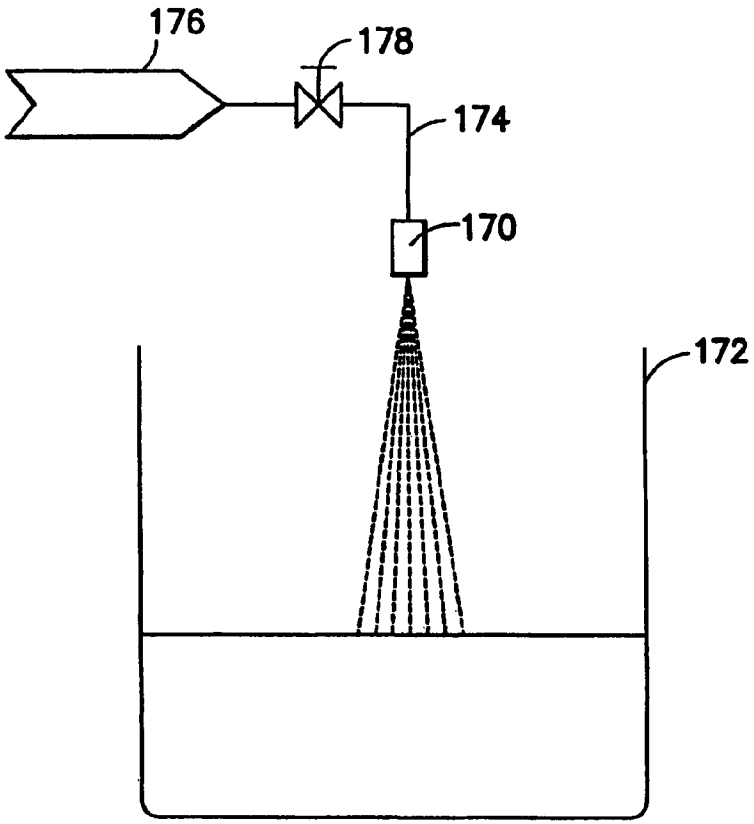
FIG.8A PRIOR ART
FIG. 8A (PRIOR ART) is an illustration of the standard method of filling a container using a nozzle.

FIGS. 8A and 8B are illustrations comparing two methods of discharging ultra pure liquid using a nozzle 170. Shown in FIG. 8A (PRIOR ART) is a nozzle 170 through which liquid is discharged into a container 172. The nozzle 170 is connected to a fill line 174, which is connected to an ultra pure liquid source 176 and is regulated by a valve 178. The discharge nozzle 170 is located above the container 172 so that as liquid is discharged from the nozzle 170, the liquid sprays onto an open bath in the container 172. This results in air entrainment and increases the air-liquid interfacial area in liquid filling of the container 172.

FIG. 8B illustrates an alternative method of utilizing a nozzle to fill a container, which reduces particle generation in the liquid. Shown in FIG. 8B is a nozzle 180 for filling a container 182. The nozzle is connected to fill line 184, which is connected to an ultra pure liquid source 186. The flow of liquid through the fill line 184 is controlled by a valve 188. The nozzle 180 is located below a surface 190 of the liquid in the container 182. As a result of submerging the nozzle 180, the fluid flow into the container is much less turbulent, and has reduced splashing and air entrainment.

Figure 9:
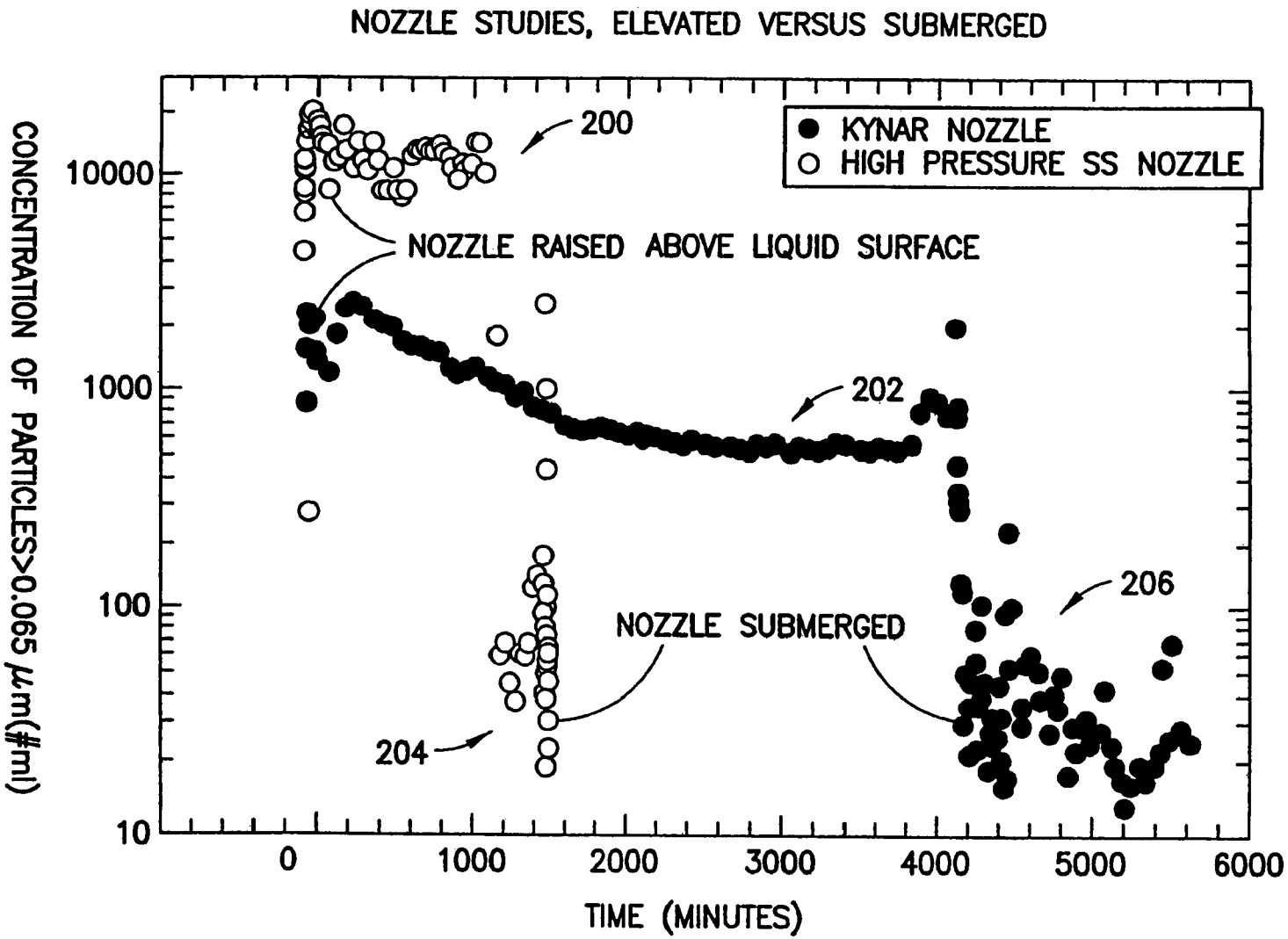
FIG. 9 is a graph illustrating the particle concentration over elapsed time for both submerged nozzles and nozzles above the surface.

FIG. 9 highlights the effects of the submerged nozzle on reduction of the particle concentration in the liquid in the bath. FIG. 9 is a graph illustrating measurements of particle concentrations taken over an elapsed time for both a system having a submerged nozzle and a system having a nozzle located above the liquid surface. To obtain the data for FIG. 9, ultra pure water was sprayed through a nozzle into an open bath in a stainless steel container. The spray water was directed at the surface of the water in the bath, and did not strike any solid surfaces. Water from the bath was directed through an optical particle counter to measure particle generation as a result of spraying. Two types of nozzles were used, a high pressure stainless steel nozzle and a Kynar nozzle. Both types of nozzles were first held three inches above liquid surface of the bath, and then were submerged.

The y-axis of FIG. 9 illustrates the concentration of particles, shown as the number of particles per milliliter for particles having a size of less than 0.065 micrometers. The x-axis gives an elapsed time in minutes. The concentration of particles caused by the stainless steel nozzle when it was held above the surface of the liquid are in a first cluster 200, while the concentration of particles caused by the Kynar nozzle when it was held above the surface of the liquid are shown by a cluster 202. The particle concentration, which occurred after the nozzles were submerged is shown by clusters 204 and 206.

The results in FIG. 9 show a dramatic increase in particle generation when the nozzles were held above the surface of the water. Comparatively, when the nozzles were submerged below the surface, the particle concentrations were much lower. These results show that the presence of an increased air-liquid interface, such as that caused by a nozzle located above the liquid surface, is associated with intense particle generation in operating nozzles.

Submerged nozzle systems, such as those variously illustrated in the above-described drawings, can be used to deliver liquid or create a liquid jet for cleaning or other purposes. As the results of the above experiments show, regardless of the purpose of the nozzle, i.e., cleaning or filling, to minimize particle generation, the nozzle system should be configured to allow the nozzle to be submerged.

REDUCTION OF WEIR OVERSPILL DISTANCE

Figure 10A:
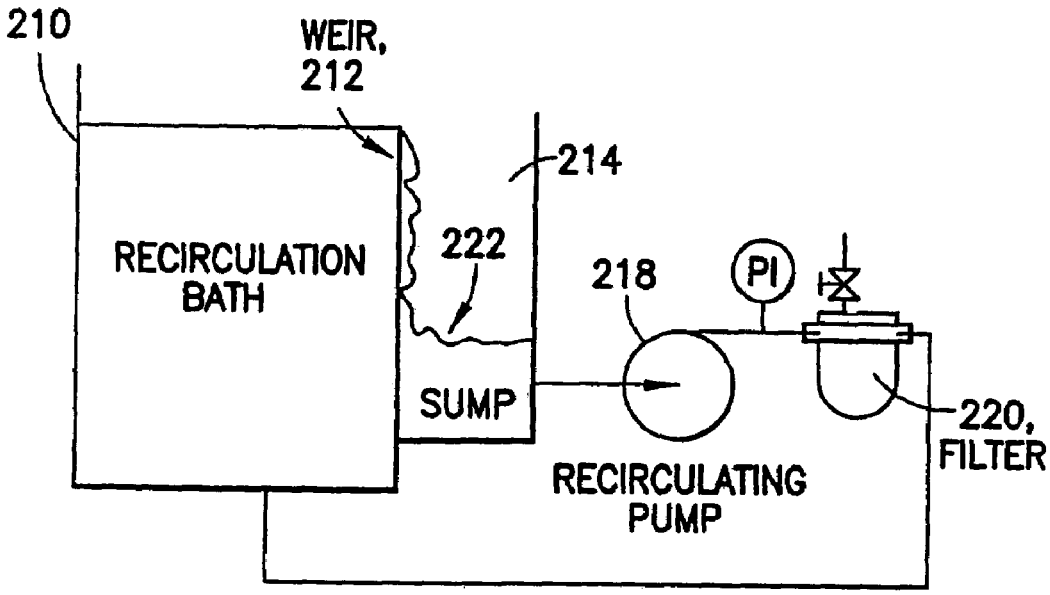
FIG. 10A is an illustration of liquid in a recirculation bath overspilling a weir into an overflow sump area.
Figure 10B:
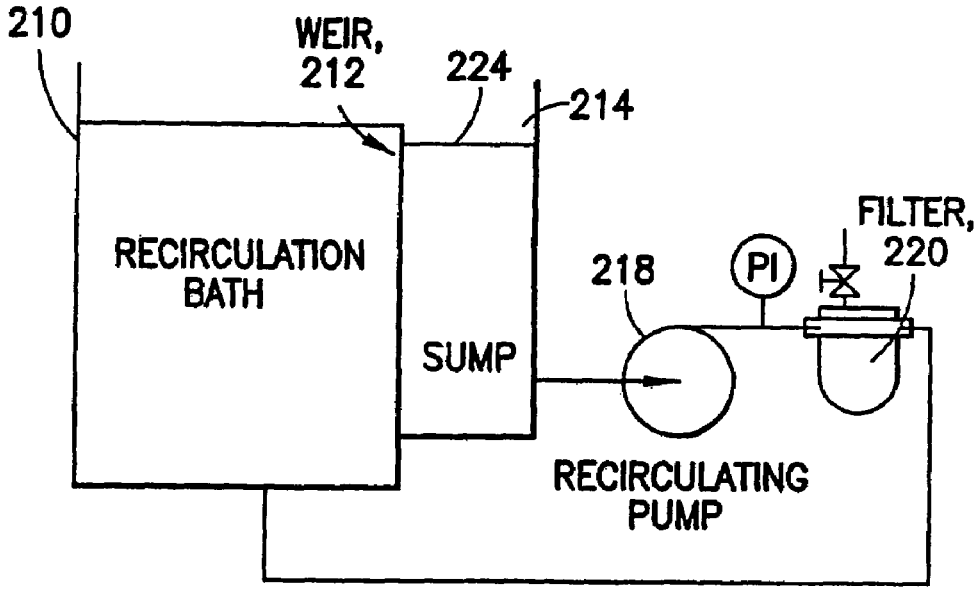
FIG. 10B is an illustration of liquid in a recirculation bath overspilling a weir into an overflow sump area in a manner, which reduced particle formation in the liquid.

Another aspect of the present invention relates to minimizing the generation of particles in a liquid that has overspilled a weir into an overspill area. This can be accomplished by minimizing the distance between the weir and the water level in the overspill area. FIGS. 10A and 10B illustrate the concept of reduction of weir overspill distance. Shown in FIG. 10A is a recirculation bath 210 having a weir 212 over which liquid spills into an overspill trough or sump 214. The overspill trough 214 connects to a recirculating pump 218 for recirculating the liquid in the bath system. The recirculating pump 218 pumps the liquid through a filter 220 and back into the recirculation bath 210.

In FIG. 10A, the level of liquid 222 in the overspill trough 214 is low enough so that when the liquid overspills the weir 212, the liquid falls into the trough, causing splashing, bubbling, turbulence, and entrainment of air. The system in FIG. 10B shows a level of liquid 224 in the overspill trough 214 that is much higher in elevation relative to the top edge of the overflow weir 212. As a result, the distance the liquid must fall as it overspills the weir 212 is greatly reduced. This allows the liquid to enter the overspill trough 214 in a manner that reduces splashing, bubbling, turbulence, and entrainment of air.

Figure 11:
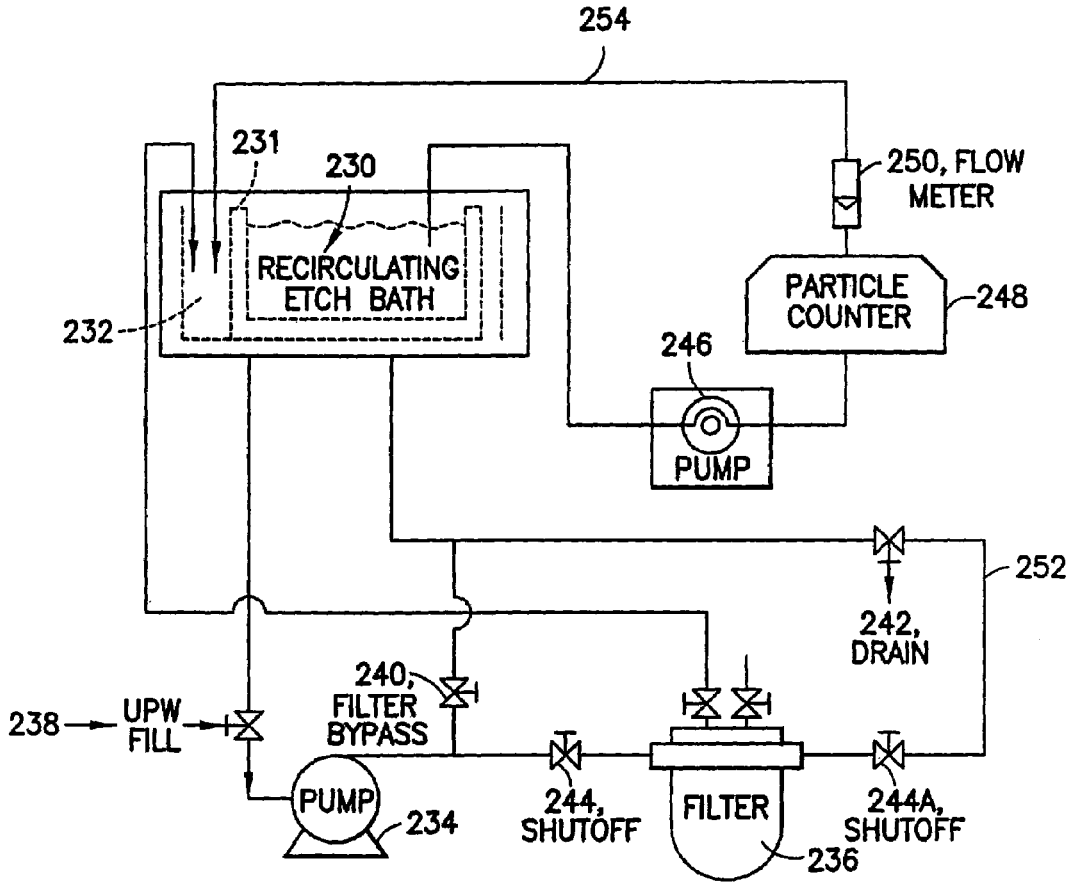
FIG. 11 is an illustration of a system in which water spilling from a bath over a weir into the sump for the recirculating pump is tested for particle concentration.

Studies were performed to determine the level of particle generation in water spilling from a bath over a weir into a sump. FIG. 11 is an illustration of the test system used in performing the studies. Shown in FIG. 11 is a recirculating etch bath 230, sump 232, circulation pump 234, and filter 236. Located between the bath 230 and the sump 232 is a weir 231 over which water can spill from the bath 230 into the sump 232. In addition, the system comprises an ultra pure water source 238, a filter by-pass valve 240, a drain 242, and shut-off valves 244 and 244A. Also connected to the bath 230 is a sample pump 246, particle counter 248, and flow meter 250.

The system of FIG. 11 comprises two flow loops. A main flow loop 252 connects the sump 232 to the circulation pump 234 and filter 236. One suitable filter 236 used during testing was a 0.2 micrometer rated UPE filter. During testing, the main flow loop 252 was operated at 50 liters per minute through the bath 230, sump 232, circulation pump 234, and filter 236. The bath 230 was a 60 liter bath constructed of PVDF, and the remainder of the wetted materials in the pump 234, such as the tubing and filter housing, were Teflon PFA. The flow circuitry and valving 240, 244, 244A were configured to allow the filter 236 to be bypassed during some of the tests.

The secondary flow loop 254 comprises a secondary flow path, through the sample pump 246, the particle counter 248, and the flow meter 250. The secondary flow loop 254 was operated at a flow rate of 50 ml/minute and was used to determine a particle concentration in the water. The test system illustrated in FIG. 11 shows that the particle sample was normally taken from the bath 230. However, the sample could also be taken from the sump 232. In addition, while the liquid source 238 is described as supplying ultra pure water, the bath could be run with HF, HCl, or any other fluid in which the particle concentration is to be strictly controlled.

Figure 12:
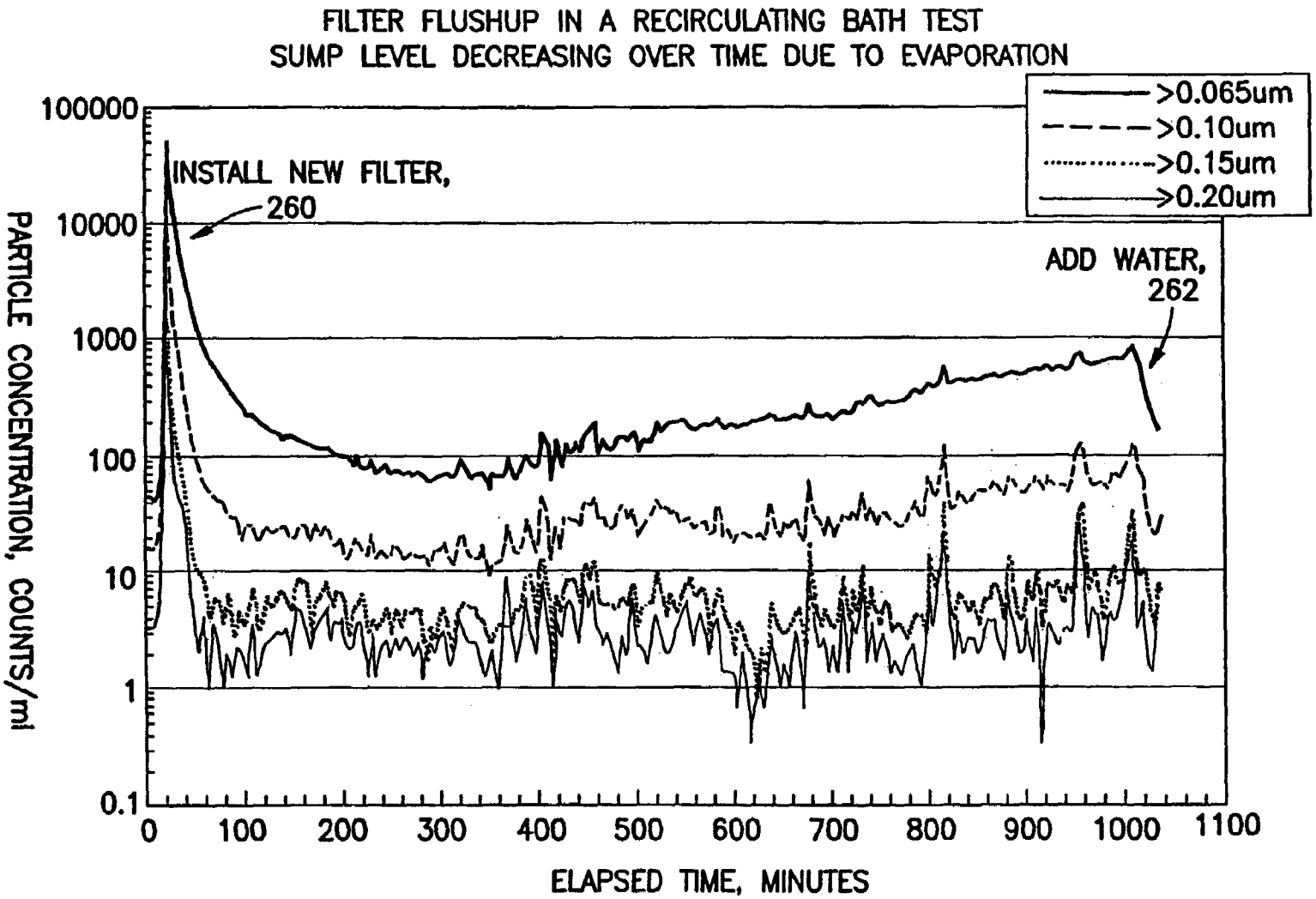
FIG. 12 is a graph indicating the particle concentration over an elapsed time of a filter flush up in a recirculating bath test.

FIG. 12 is a graph illustrating the results of running the bath 230 overnight after installing a new filter 236. To obtain the data used to generate the graph of FIG. 12, the particle measurement was done in the bath 230 and the filter 236 was brand new. Initially, the water level in the sump 232 was running about an inch below the water level in the bath 230 and there was no evidence of splashing or bubbling as the water from the bath 230 overspilled into the sump 232. As can be seen on FIG. 12, there was a normal "flush-up" curve 260 for the new filter 236 during the first few hours of particle data.

Eventually, evaporation caused the level of water in the sump 232 to drop over time, increasing the spill distance over the weir 231. As this distance increased, the turbulence in the sump 232 due to water spilling over the weir 231 also increased. There was also a gradual increase in the particle concentration in the bath 230 after about 200 minutes. This was attributed not to loss of filter 236 retention, but rather to an increased challenge concentration of particles at the filter 236 inlet due to particle generation in the sump 232.

After 18 hours of operation, evaporation caused a significant drop in the water level of the sump 232, and the water spilling into the sump 232 caused significant splashing and bubbling. Water was added to the system using the water source 238. When enough water was added to the bath 230 to raise the level in the sump 232 to the point where the splashing and bubbling activity disappeared, the particle level in the bath 230 decreased dramatically in the two smallest size channels of the particle counter. This effect is shown by the drop off curve 262 in FIG. 12.

In the system used to obtain the data for FIG. 12, particle measurement was made in the bath 230, downstream of the filter 236. The particle generation source was concluded to be in the sump 232, which was located upstream of the filter 236. Thus, at least some of the generated particles passed through the filter 236, especially those particles that were significantly smaller than the pore size rating of the filter. The results showed that even with filter protection, and constant recirculation, a large generation of particles in a fluid could be observed, even downstream of a filter 236. The use of the filter 236 and the size discrimination seen in the data is further evidence that the phenomena being measured by the particle counter 248 was not simply "bubbles" entering the flow cell of the counter 248.

This sequence of events, including the particle flush up from a new filter 236 followed by evaporation of the liquid so that particles are generated in increasing numbers as the spill height over the weir 231 increased, was recorded for numerous and different types of filters 236 placed in the recirculating bath system. It was also seen in situations where dilute concentrations of HF and HCl were used in the bath system.

To highlight the effect of the filter 236, a second test was performed using the system illustrated in FIG. 11. During the second test, the main flow loop 252 was run until the system was clean. Next, the valves 244 and 244A were configured so that the system was put into a "filter bypass mode." In the filter bypass mode, the system was recirculating water, but the water did not pass through the filter 236. As a result, there was no removal of any of the particles in the system by the filter 236.

Figure 13:
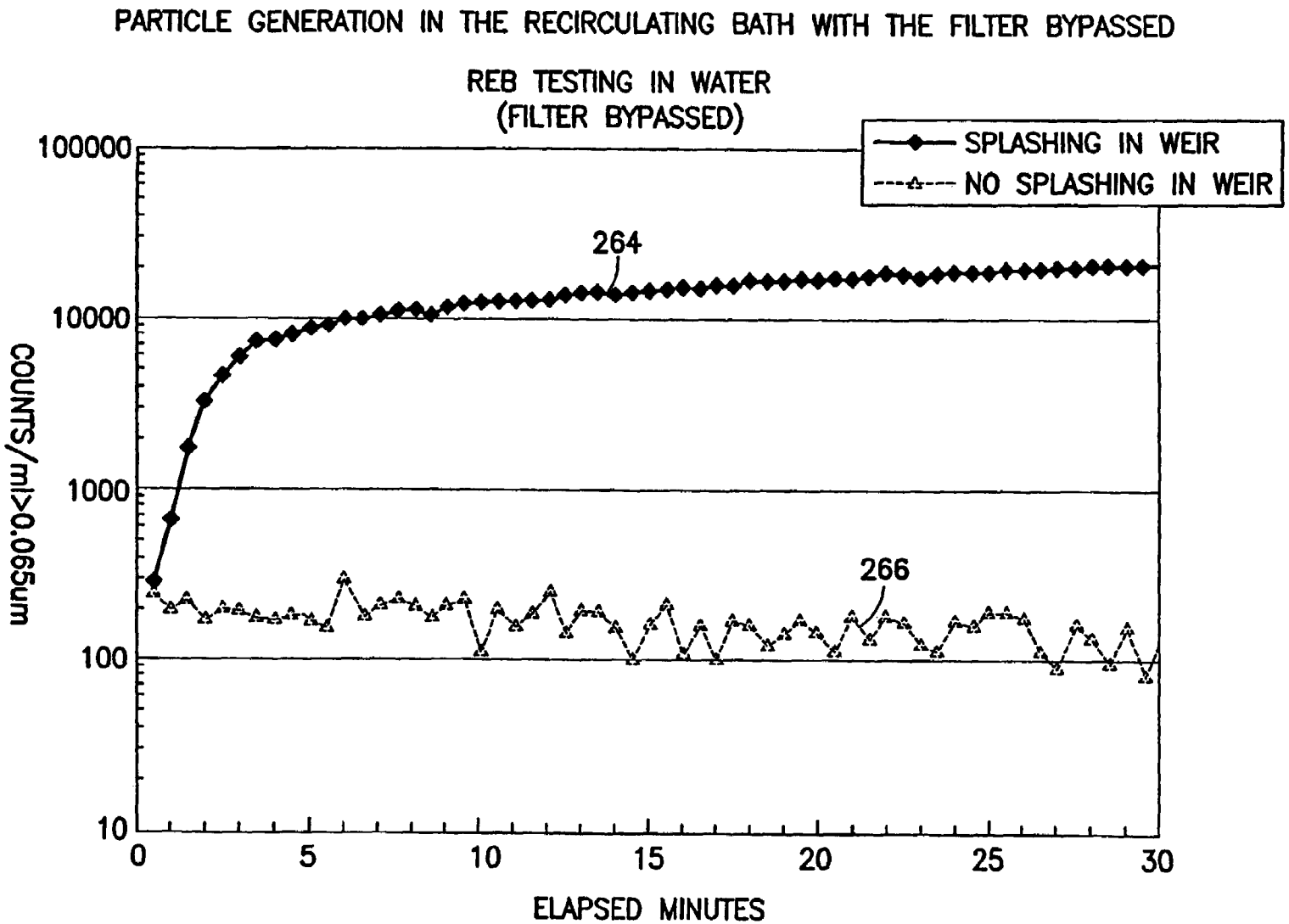
FIG. 13 is a graph indicating the particle counts over elapsed time for a recirculating bath with a filter bypass.

FIG. 13 is a graph illustrating the results of the filter bypass mode test. In FIG. 13 there are two curves. The first curve 264 indicates the particle counts for water tested when there was splashing as the water overspilled the weir 231. The second curve 266 indicates the particle counts for water tested when there was no splashing as the water overspilled the weir 231. As can be seen from the first curve 264, when the distance between the water level in the bath 230 and the sump 232 was large, there was significant particle generation caused by liquid spilling over the weir 231 and splashing in the sump 232. The number of particles built up quickly in the bath 230 to a concentration of over 10,000 per milliliter for particles greater than or equal to 0.065 micrometer diameter.

During control tests using the same filter bypass method, the same flow rate, and the same pump, the particle concentration remained near 100–200 per milliliter for particles greater than or equal to 0.065 micrometer diameter, during a thirty minute test. The only way the control test differed was that the distance between the water level in the bath 230 and the sump 232 was small, and no splashing was observed in the sump 232 as the water overspilled the weir 231. Again, the test was repeated in many forms to verify that the results were consistent. The pump used in this system ran relatively cleanly, and contributed very little particle shedding in the system, as shown by the control data.

SMART SIPHONING

Figure 14:
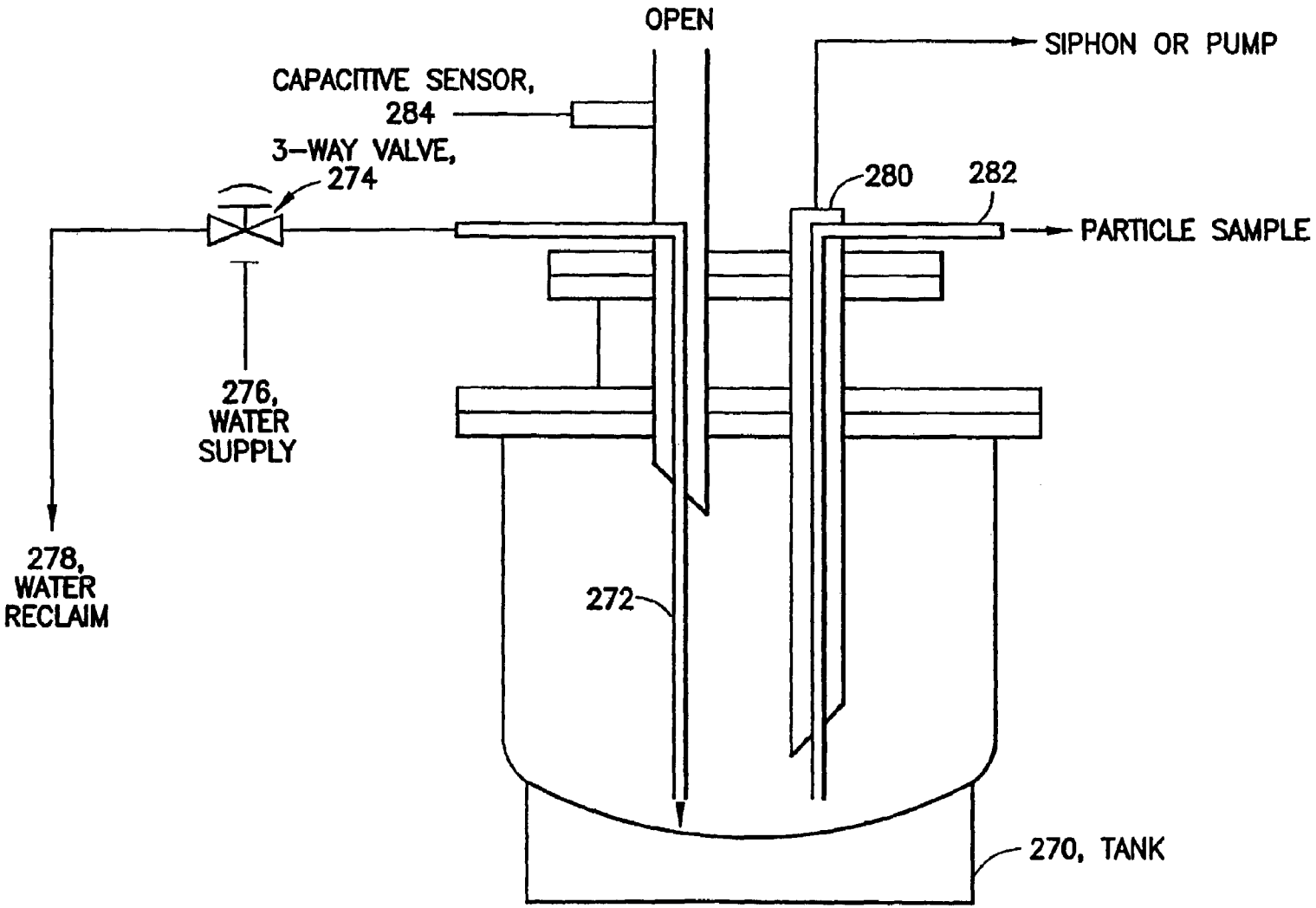
FIG. 14 is an illustration of a siphoning system for filling a tank.

FIG. 14 is an illustration of a common method of siphoning. Shown in FIG. 14 is a tank 270 with a fill tube 272. Connected to the fill tube 272 is a three way valve 274 that regulates flow into the tank from an ultra pure water supply 276 and diverts water from the water supply 276 to a water reclaim area 278. Also connected to the tank 270 were a siphon tube 280 and particle sample tube 282. Finally, a capacitive sensor 284 is located on the tank 270.

Experiments were performed on the siphoning system shown in FIG. 14 to determine the effect of the siphoning system on particle generation. When performing the experiments, a 15 liter ECTFE fluoropolymer tank 270 was used. The water level in the tank 270 was cycled up and down using the fill tube 272 and the siphon tube 280. Particle sampling was performed continuously from the tank 270 via the particle sample tube 282 using a gravity feed method. A 30 second averaging/sample interval was chosen for obtaining the particle data.

The fill flow rate from the water supply 276 was set at 1 liter per minute. The capacitive level sensor 284 was used to detect a high level on the tank 270. Once the high level was detected, the sensor 284 activated a PLC (not shown in FIG. 14) to turn on a timing control signal for four minutes. The timing signal was used to activate a siphon connected to the siphon tube 280, such as by opening a valve, so that water was drawn out of the tank at 2.5 liters per minute by the siphon. In addition to connecting a siphon to the siphon tube 280, a pump was sometimes substituted.

The control signal also activated the three-way valve 274 to divert the ultra pure water supply away from the test tank 270 and to the water reclaim area 278 during the tank 270 draining process. After the four minutes were up, the test tank 270 was then refilled with water for ten minutes at 1 liter per minute, and a new cycle sequence was begun. In this way, the water level in the tank 270 was cycled up and down smoothly on a regular basis.

In some of the tests, the high level sensor 284 and control signal were deactivated, and the valve on the siphon tube 280 was held continuously open so that once a high water level was reached, the system would generate a siphon. Once enough water had been siphoned, the water level in the tank 270 would be so low that the siphon would break due to entrained air, letting any of the water in the siphon tube 280 fall back down into the tank 270. During these tests, the three way valve 274 was overridden so that the one liter per minute water supply 276 was constantly sending water to the tank 270 at all times.

Another variable that was adjusted was the height of the fill tube 272 in the tank 270. Some tests were conducted using a top fill method, with the fill tube 272 positioned in the tank 270 so that water filled from the top of the tank 270. Other times a bottom filling method was used, wherein the fill tube 272 was positioned near the bottom of the tank 270 so that the fill tube 272 always remained submerged below the water level in the tank 270.

Figure 15:
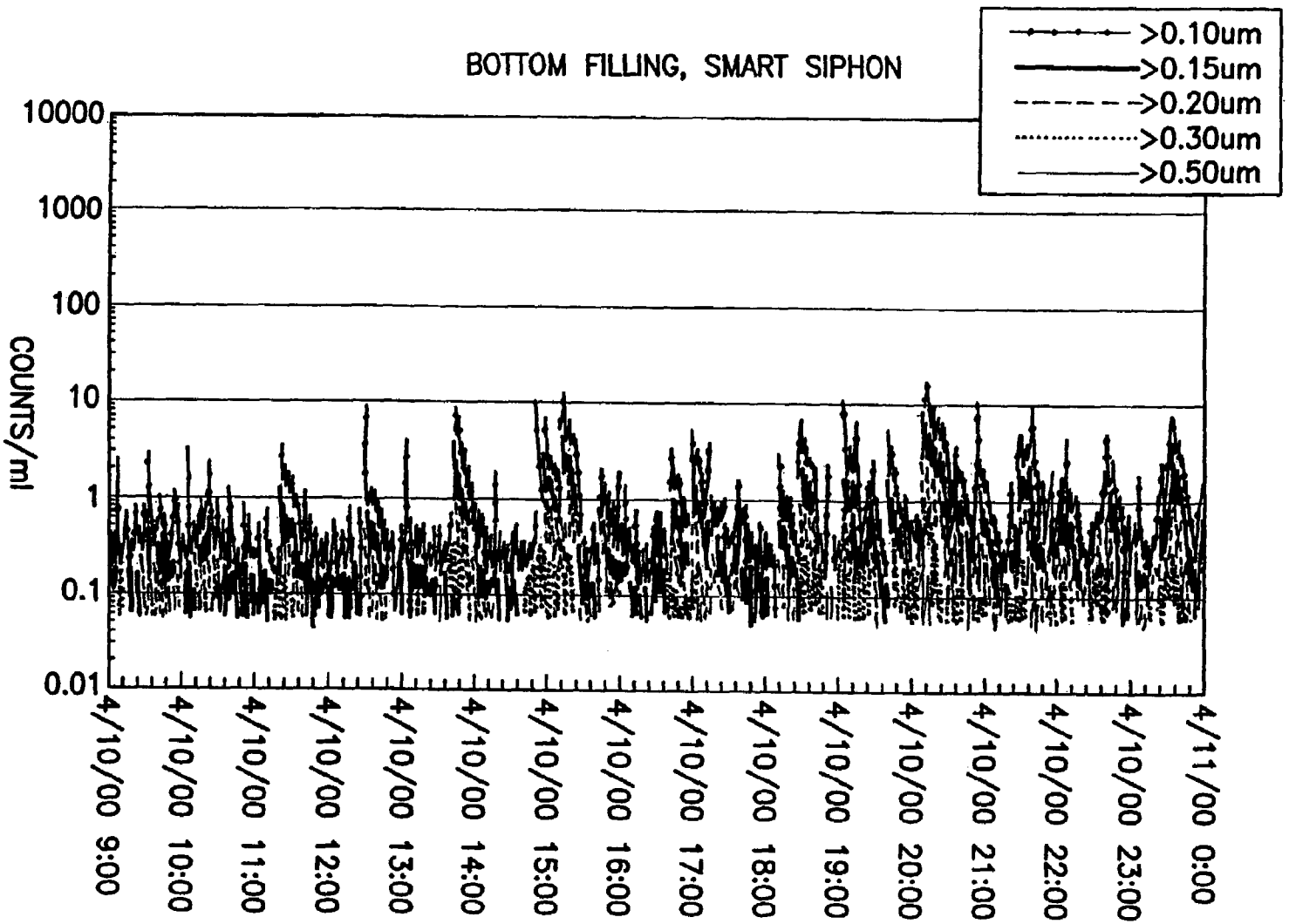
FIG. 15 is a graph illustrating the particle counts over elapsed time for a bottom filling smart siphon.

FIG. 15 is a graph illustrating the best case scenario of filling a tank using a siphon. In obtaining the data for the graph of FIG. 15, a bottom filling fill tube was used in addition to a "smart" siphon. A smart siphon refers to a siphon system using the high level sensor 284 to create a timing signal that enabled the siphon to be stopped before the fluid level reached the bottom of the siphon tube 280, and thus before the siphon was allowed to break the siphoning action.

Even though the level of water in the tank 270, and thus the air-liquid interface, was cycled up and down, the resulting particle levels were relatively low. The average particle levels were near 1.2 particles per milliliter for particles having a size less than or equal to 0.10 micrometer diameter. This is not as good as the particle levels seen when measuring the incoming water supply, which had average particle levels of near 0.03 per milliliter for particles having a size less than or equal to 0.10 micrometer diameter.

As shown in FIG. 15, particle bursts occurred every few hours. However, the maximum particle concentration reached was only about 20 particles per milliliter for particles having a size less than or equal to 0.10 micrometer diameter. The time scale of the testing graphed in FIG. 15 covered about 15 hours.

Figure 16:
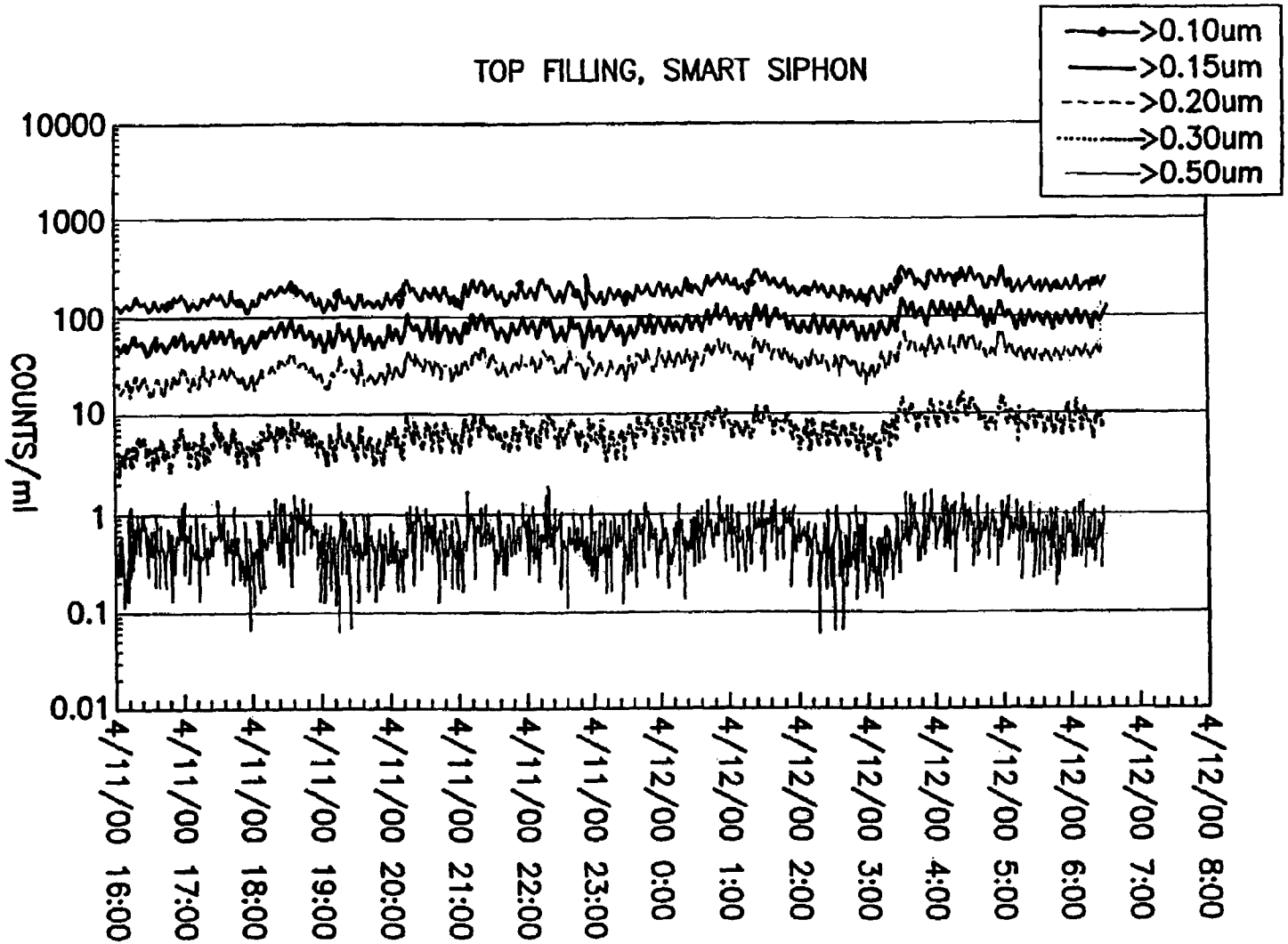
FIG. 16 is a graph illustrating the particle counts over elapsed time for a top filling smart siphon.

FIG. 16 is a graph illustrating the data collected from a test system using top filling and a smart siphon. For the data obtained for FIG. 16, the fill tube 272 was located above the surface of the water in the tank 270, so that the water fell into the tank 270, causing splashing and bubbles. A smart siphon was still implemented during collection of this data. As can be seen by comparing the graph in FIG. 15 with the graph in FIG. 16, the particle levels are about one hundred times higher during top filling than during bottom filling. In addition, the frequency of the tank cycling is visible in the particle data.

Figure 17:
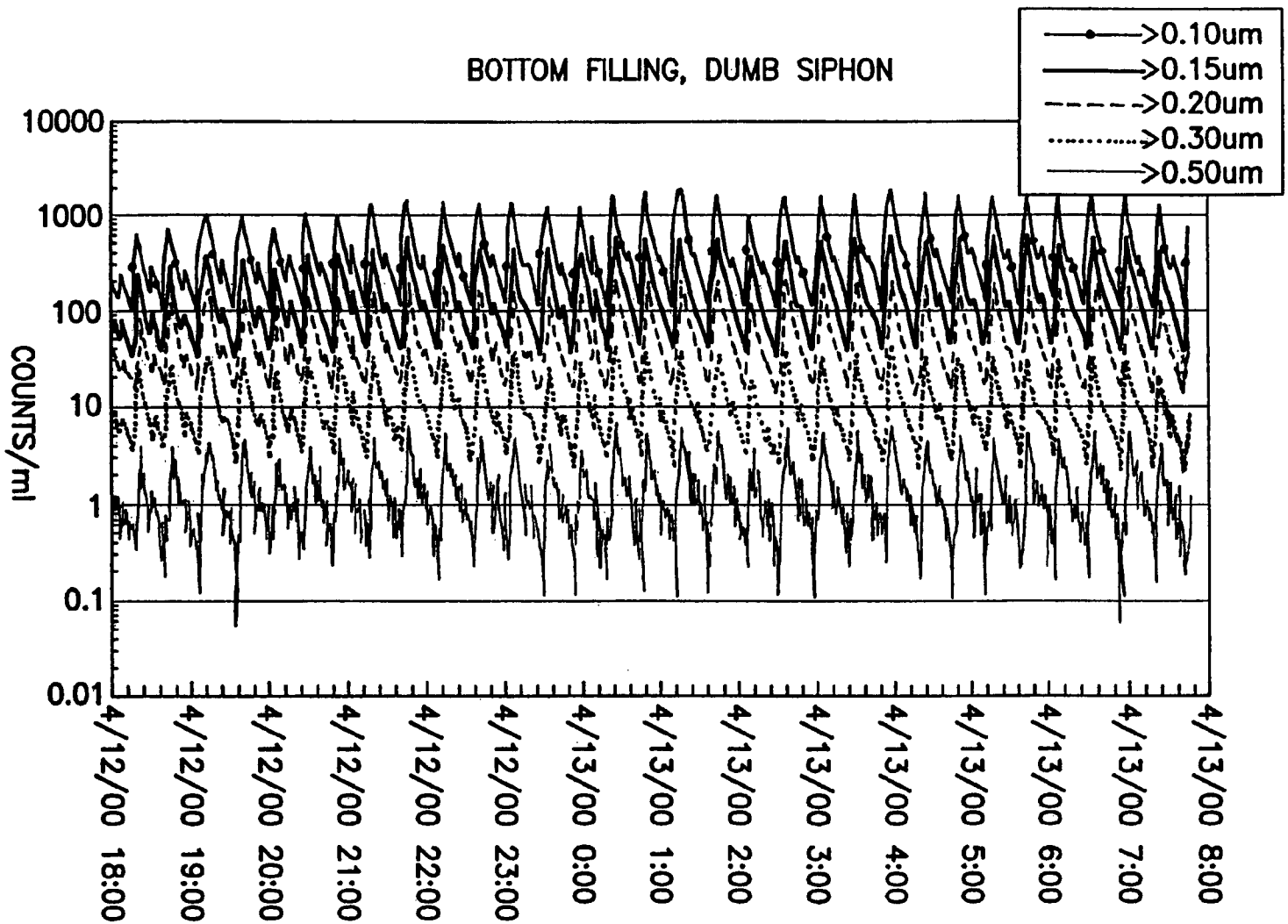
FIG. 17 is a graph illustrating the particle counts over elapsed time for a bottom filling dumb siphon.
Figure 18:
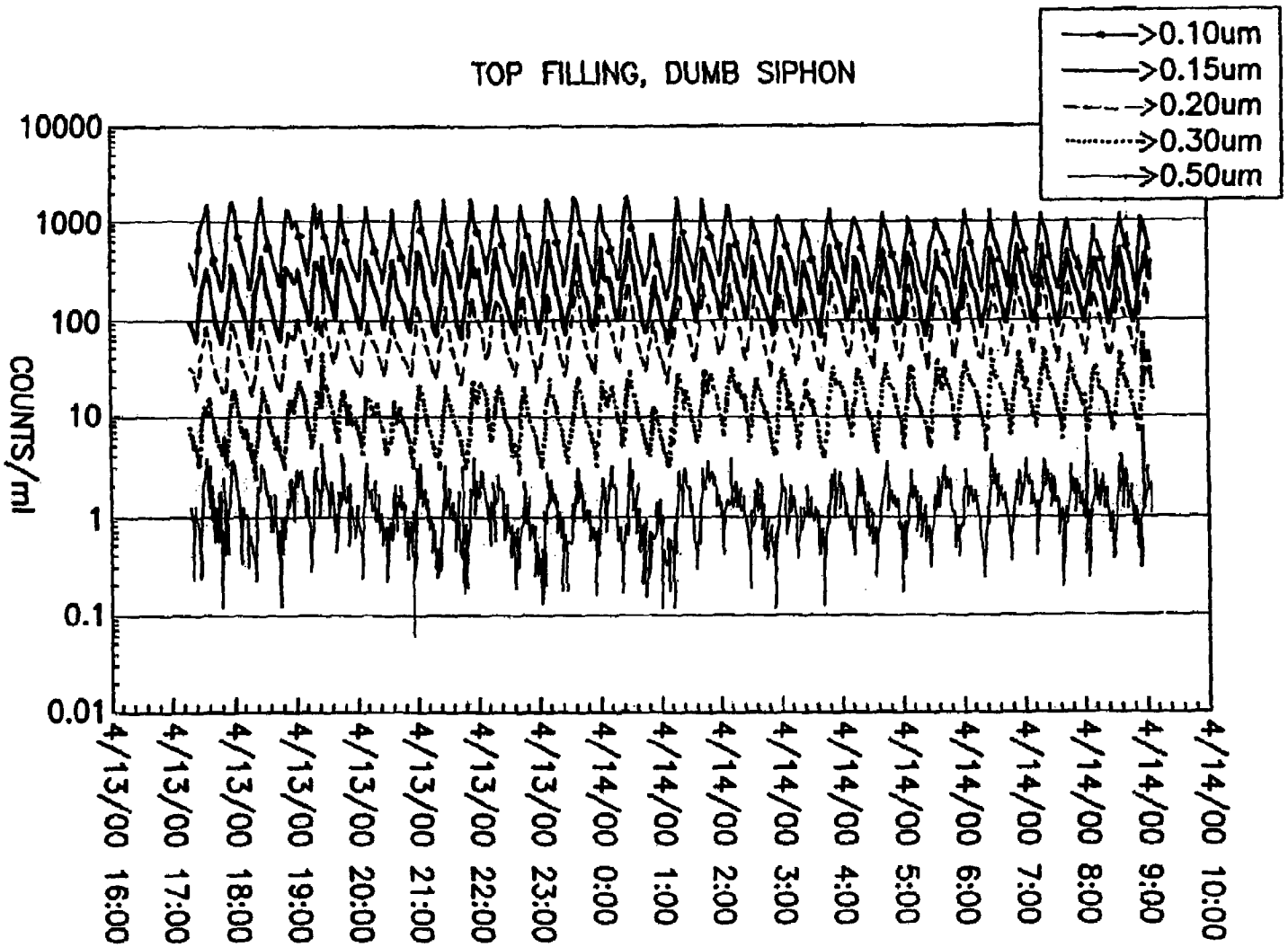
FIG. 18 is a graph illustrating the particle counts over elapsed time for a top filling, dumb siphon.

FIGS. 17 and 18 illustrate data collected using a dumb siphon. A dumb siphon refers to a siphon that is allowed to break the siphoning action by air entrainment. FIG. 17 illustrates a system using bottom filling with a dumb siphon, while FIG. 18 illustrates a system using top filling with a dumb siphon.

As can be seen in both FIGS. 17 and 18, there is a spike in the particle levels just after the siphon breaks, followed by a drop in the particle levels as low particle level water is added to the tank 270. This cycle repeats itself, with a spike of particles each time the siphoning action breaks, and a drop each time low particle level water is added to the tank 270. Again, data were collected over 15 hours. There are little or no apparent long-term clean-up trends in the data, and the frequency of the tank cycling sequence is clearly visible in the particle data. Note that the frequency of the tank fill and dispense cycle in FIGS. 17 and 18 was not held constant. Rather, some cycles were faster while other cycles were slower.

Table 5 below is a numerical summary of the results of the experiments shown in FIGS. 15–18. The data show that both filling from the top or allowing air entrainment to break the siphoning action cause higher particle concentration in the tank.

TABLE 5

| | Average particle size Average Particle Concentration (#/ml) | | | | |
|---|---|---|---|---|---|
| Method | 0.10 μm | 0.15 μm | 0.20 μm | 0.30 μm | 0.50 μm |
| bottom fill, smart siphon | 1.2 | 0.51 | 0.26 | 0.086 | 0.019 |
| top fill, smart siphon | 190 | 81 | 35 | 6.9 | 0.64 |

TABLE 5-continued

| Method | Average particle size Average Particle Concentration (#/ml) | | | | |
|---|---|---|---|---|---|
| | 0.10 μm | 0.15 μm | 0.20 μm | 0.30 μm | 0.50 μm |
| bottom fill, dumb siphon | 470 | 150 | 56 | 11 | 1.5 |
| top fill, dumb siphon | 590 | 220 | 82 | 13 | 1.3 |

REMOVAL OF HEAD SPACE

When a partially full container is shaken, high particle concentrations are generated in the liquid. This same phenomenon is often observed when the container is shipped. When packaging some liquids, it may be necessary or desirable to leave an amount of head space in the container to allow the liquid in the container to expand. To create this head space, the container is not filled to maximum capacity, but rather is filled to a level so that an amount of air exists between the top of the liquid and the top of the container. As the container is shipped, the liquid in the container may splash and slosh in the container due to this head space. Another method of reducing particle generation is to remove any head space air from a container subsequent to filling so that any air-liquid interface in the container is reduced or eliminated, and particle generation thereby is minimized during shipping and other movement of the container.

Figure 19B:
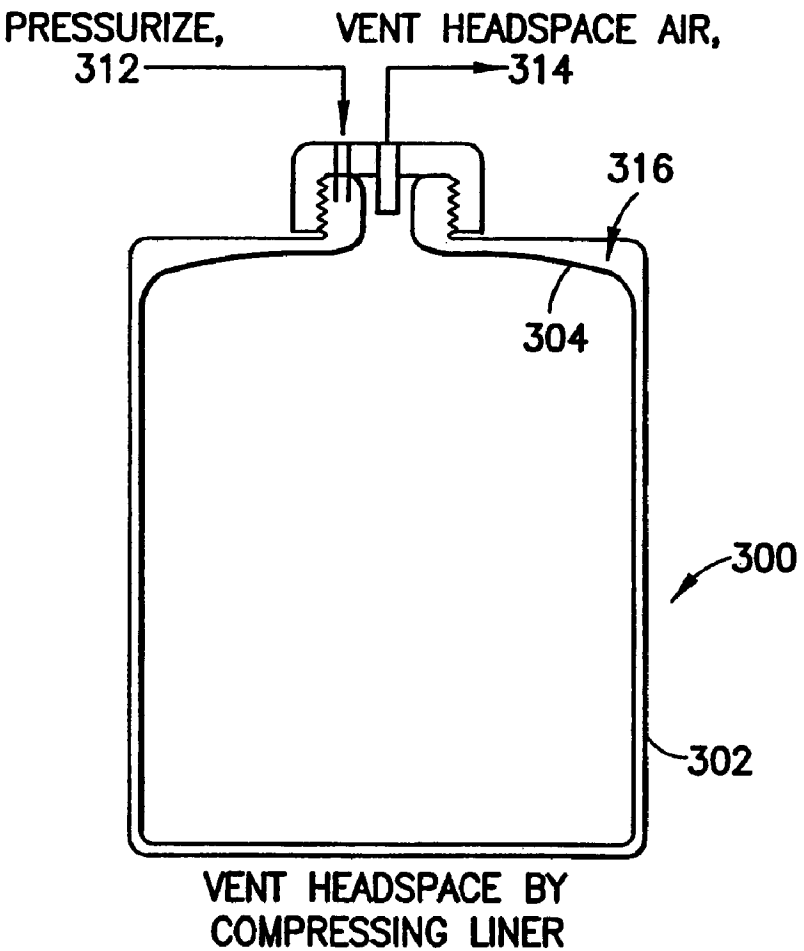
FIGS. 19A and 19B are illustrations of a met hod of filling a container and removing the head space in the filled container.
Figure 19A:
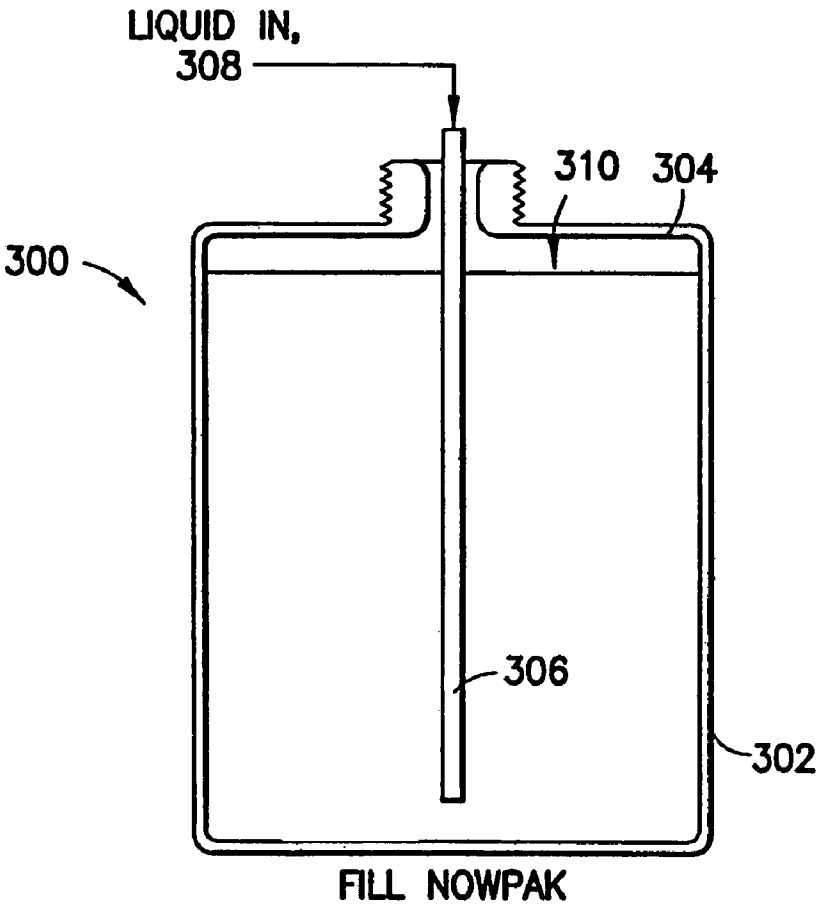

FIGS. 19A and 19B illustrate an open fill method, with a removal of head space air. Shown in FIGS. 19A and 19B is a lined container 300 similar to that described above with reference to FIG. 3. The lined container 300 comprises a rigid outer container 302 with a liner 304 located inside the rigid outer container 302. Disposed in the liner 304 is a dip tube 306. The dip tube 306 is connected to a fill line 308 for supplying the container with liquid. The liner 304 is not collapsed before filling.

FIG. 19A illustrates the step of filling lined container 300 with a liquid. Liquid flows from fill line 308, through dip tube 306, and into liner 304. When lined container 300 is filled to a desired level, a head space 310 exists between the level of liquid in the liner 304 and the top of the liner 304.

FIG. 19B illustrates the step of removing the head space 310 from the container 300. In FIG. 19B, an air inlet 312 is shown, in addition to a liner air vent 314 for venting the head space air. The air inlet 312 connects to an intermediate area 316 located between the rigid outer container 302 and the inner liner 304. To remove the head space 310, air is supplied to the intermediate area 316 via the air inlet 312. At the same time, the inside of the inner liner 304 is exposed to the liner air vent 314. The increased pressure between the rigid container 302 and liner 304 caused by the air from the air inlet 312 compresses the liner 304. As the liner 304 compresses, the head space air is vented from inside the liner 304 using the liner air vent 314. The liner 304 is compressed until substantially all the head space air is removed from the liner 304. The container 300 is capped and the liner 304 can be sealed to prevent air from reentering.

In addition to venting only the air that occupies the head space, it is possible to fill the liner in an amount which is greater than the desired amount of liquid to be held in the container. After over filling the liner, the liner can then be purged by an amount that yields the finished volume desired to be held in the container. In this manner, the presence of any head space air is likewise avoided.

Figure 20A:
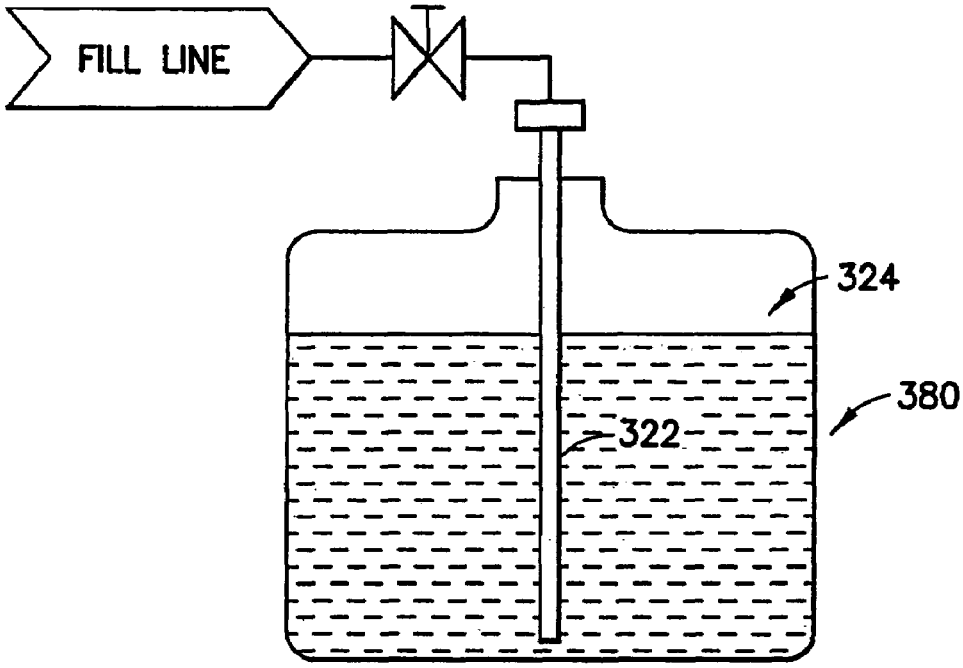
FIGS. 20A and 20B are illustrations of a method of filling a container and removing the head space using an inert bladder.
Figure 20B:
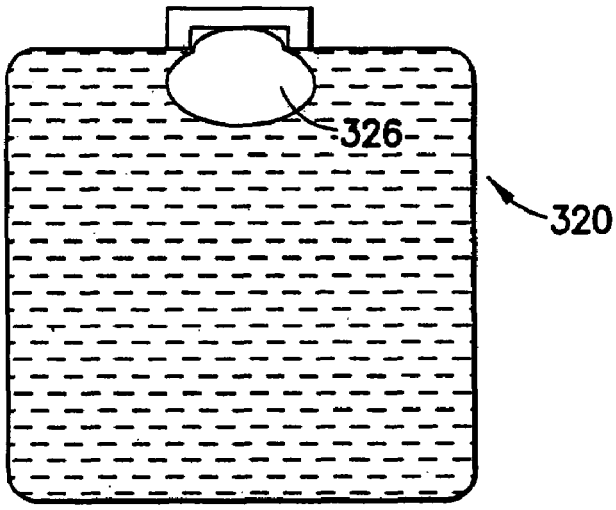

FIGS. 20A and 20B illustrate another method of removing the head space in a container used to transport ultra pure liquids. FIG. 20A shows a container 320 filled according to a bottom fill method using a dip tube 322. To remove the air liquid interface created by a head space 324, FIG. 20B shows the insertion of an inert bladder 326 into the remaining head space in the liner. Alternatively, the head space air may be reduced by pressurizing an area between the liner and the rigid container to vent the head space air.

The inert bladder serves to occupy the headspace area, and thus isolate the air from the liquid. The removal of head space 324 eliminates the air-liquid interface, which in turn minimizes particle generation in the water caused by shipping.

In addition to using the method described above with reference to FIGS. 19A–B and 20A–B, it is possible to obtain a liner having zero head space by filling the container using the collapsed liner fill method described more fully above with reference to FIG. 3. The collapsed liner fill method, in addition to allowing the container to be filled and dispensed without the presence of an air-liquid interface, also provides a method of filling a container with no remaining head space.

The benefits of a zero head space fill method compared to an open fill method are apparent from the data set out in Table 6 below. To obtain the data set out in Table 6, two methods of filling a container were tested. The first method tested was a standard open fill method, in which an inflated liner was filled with particle-free water. As can be seen from Table 6, when the water was subsequently tested for particles, the particle concentration of the water invariably increased. The exact particle concentration varied somewhat from test to test for the same type of liner. In addition, the particle concentration can vary significantly from one liner type to another, as for example a PTFE liner versus a PEPE liner.

The second method tested to obtain the data in Table 6 was a zero head space fill method. The zero head space fill method, similar to the collapsed liner fill method, involved first placing a liner in the rigid outer container. Next, the liner was inflated enough to allow the insertion of a dip tube. Attached to the dip tube assembly was a probe. Preferably the probe was configured like a recycle probe, so that the probe had two ports leading into the liner, a fill port and a vent port. The space between the liner and the rigid outer container was pressurized to collapse the liner completely by venting the air in the liner out the vent port. The liner was then filled using the fill port, which was attached to the dip tube. The container was dispensed by likewise using the dip tube.

This fill method virtually eliminated the air liquid interface as the liner was filled. As a result, it was observed that particle shedding was significantly reduced during filling. It follows that even during shipping, the removal of the head space ultimately results in reducing the level of particles in the dispensed fluid.

TABLE 6

| Average particle size | Concentration of Particles (#/ml) | | | |
|---|---|---|---|---|
| | 0.10 μm | 0.15 μm | 0.20 μm | 0.30 μm |
| Open fill method | 56 | 23 | 7.6 | 1.3 |
| Zero head space fill method | 4.2 | 1.5 | 0.77 | 0.13 |

Although the present invention has been described with reference to preferred embodiments, workers skilled in the art will recognize that changes may be made in form and detail without departing from the spirit and scope of the invention. In particular, it should be recognized that the particle generation in a container can vary based on the type of container, type of liner, and type of fluid introduced into the container. However, any liquid that has product performance criteria that are dependent on low particle levels will benefit from the above disclosed filling and packaging methods. Such liquids include ultra pure acids and bases used in semiconductor processing, organic solvents used in semiconductor processing, photolithography chemicals, CMP slurries and LCD market chemicals.

The features and advantages of the invention are more fully shown with respect to the following example, which is not to be limitingly construed, as regards to the character and scope of the present invention, but is intended merely to illustrate a specific preferred aspect useful in the broad practice of the present invention.

EXAMPLE 1

From the same lot of Oxide Slurry OS-70KL material (ATMI Materials Lifecycle Solutions, Danbury, Conn.) several different sample vials were made up, containing the OS-70KL material, to simulate behavior of the liquid in a bag in a drum container of the type generally shown and described herein and in U.S. patent application Publication No. US2003/0004608 A1 and U.S. Pat No. 6,698,619, incorporated herein by reference in their entirety, with varying headspace in the interior volume of the liner.

The sample vials were made up with the following differing headspace levels: 0%, 2%, 5% and 10%. Each of the sample vials was vigorously shaken for one minute by hand, and the liquid in the vial was then subjected to analysis in an Accusizer 780 Single Particle Optical Sizer, a size range particle counter commercially available from Sci-Tec Inc. (Santa Barbara, Calif.), which obtains particle counts in particle size ranges that can then be "binned" algorithmically into broad particle distributions.

The data obtained in this experiment are shown in Table 7 below. The particle counts are shown for each of the particle sizes 0.57 μm, 0.98 μm, 1.98 μm and 9.99 μm, at the various headspace percentage values of 0%, 2%, 5% and 10% headspace volume (expressed as a percentage of the total interior volume occupied by the air volume above the liquid constituting the headspace void volume).

TABLE 7

Size Range Particle Counts for Varying Headspace Volumes in Sample Vials

| Average Particle Size for Range | Initial Particle Count Before Shaking | Particle Count - 0% Headspace | Particle Count - 2% Headspace | Particle Count - 5% Headspace | Particle Count - 10% Headspace |
|---|---|---|---|---|---|
| Size Range Particle Counts Immediately After Shaking Vial for One Minute | | | | | |
| 0.57 μm | 170,617 | 609,991 | 134,582 | 144,703 | 159,082 |
| 0.98 μm | 13,726 | 14,836 | 22,096 | 20,294 | 26,429 |
| 1.98 μm | 2,704 | 2,900 | 5,298 | 4,397 | 6,293 |
| 9.98 μm | 296 | 321 | 469 | 453 | 529 |
| Size Range Particle Counts 24 Hours After Shaking Vial for One Minute | | | | | |
| 0.57 μm | 110,771 | 1,198,296 | 191,188 | 186,847 | 182,217 |
| 0.98 μm | 11,720 | 18,137 | 21,349 | 20,296 | 24,472 |
| 1.98 μm | 2,701 | 2,383 | 4,658 | 4,272 | 5,704 |
| 9.98 μm | 138 | 273 | 544 | 736 | 571 |

The particle size analyzer presented the data in terms of large-size particle counts, in units of particles per milliliter>a specific particle size in micrometers (μm). The particle count data has been determined to provide a direct correlation between the magnitude of the particle count and wafer defectivity when the reagent containing such particle concentration is employed for manufacturing microelectronic devices on semiconductor wafers.

The data taken immediately after the shaking experiment show some trending toward larger particle counts with increasing headspace values, particularly for particles ≧0.98 μm. Data taken 24 hours later show the same trending toward higher particle distributions.

The data show that increasing headspace in the vial produced increasing aggregations of large size particles, which are deleterious in semiconductor manufacturing applications and can ruin integrated circuitry or render devices formed on the wafer grossly deficient for their intended purpose.

As applied to bag in a drum containers of the type shown and described herein and in U.S. patent application Publication No. US2003/0004608 A1 and U.S. Pat. No. 6,698,619, incorporated herein by reference in their entirety, the results of this Example indicate the value of the preferred zero headspace arrangement. Any significant headspace in the container holding high purity liquid, combined with movement of the container incident to its transport, producing corresponding movement, e.g., sloshing, of the contained liquid, will produce undesirable particle concentrations. Therefore, to minimize the formation of particles in the contained liquid, the headspace should be correspondingly minimized to as close to a zero headspace condition as possible.

Although the present invention has been described in detail, it should be understood that various changes, substitutions and alterations can be made hereto without departing from the spirit and scope of the invention as hereinafter claimed.

The invention claimed is:

1. A method of minimizing particle generation during handling of ultra pure liquids, the method comprising:

introducing a liquid into a container; and controlling an air-liquid interface to minimize an amount of particles generated in the liquid.

2. The method of claim 1, wherein controlling the air liquid interface to minimize the amount of particles generated in the liquid comprises controlling the air liquid interface to achieve a particle concentration of less than about 2 particles per milliliter for particles having a size of about 0.2 microns.

3. The method of claim 2, wherein controlling the air-liquid interface to minimize the amount of particles generated in the liquid comprises:

providing a liner inside a rigid container;

collapsing the liner to remove any air in the liner; and filling the collapsed liner with the ultra pure liquid.

4. The method of claim 3, wherein collapsing the liner comprises:

pressurizing an intermediate area between the liner and the rigid container to collapse the liner; and venting the liner to allow air inside the liner to exit as the liner is collapsed.

5. The method of claim 4 further comprising sealing the liner after collapsing it.

6. The method of claim 1, wherein controlling the air-liquid interface to minimize the amount of particles generated in the liquid comprises:

providing a liner inside a rigid container;

filling the liner with liquid to less than a maximum capacity so that there is a remaining head space in the liner; and reducing the head space by pressurizing an area between the liner and the rigid container and venting the head space air.

7. The method of claim 1, wherein controlling the air-liquid interface to minimize the amount of particles generated in the container comprises:

filling the liner with liquid to less than a maximum capacity so that there is a remaining head space in the liner; and reducing the head space by inserting an inert bladder into the head space.

8. The method of claim 1, wherein introducing the liquid into the container comprises allowing the liquid to overspill a weir into a sump and wherein controlling the air-liquid interface to minimize the amount of particles generated in the liquid comprises reducing an overspill distance between the weir and a water level in the sump.

9. The method of claim 1, wherein controlling the air-liquid interface to minimize the amount of particles generated in the liquid comprises:

utilizing a dip tube to introduce the liquid into the container; and submerging a tip of the dip tube in the liquid as the liquid is introduced into the container.

10. The method of claim 1, wherein controlling the air-liquid interface to minimize the amount of particles generated in the liquid comprises:

utilizing a nozzle to introduce liquid into the container; and submerging the nozzle in the liquid as the liquid is introduced into the container.

11. The method of claim 1, wherein said container is a first container, wherein introducing liquid into the container comprises siphoning the liquid from a second container into the first container, and wherein controlling the air-liquid interface to minimize the amount of particles generated in the liquid comprises controlling the siphon to prevent it from breaking its siphoning action.

12. The method of claim 1, wherein the ultra pure liquid is selected from the group consisting of acids, bases, organic solvents, photolithography chemicals, CMP slurries and LCD market chemicals.

13. A method of minimizing particle generation during handling of ultra pure liquids, the method comprising:

introducing a liquid into a container; and controlling an air-liquid interface to minimize an amount of particles generated in the liquid;

wherein controlling the air-liquid interface to minimize the amount of particles generated in the liquid comprises:

controlling the air liquid interface to achieve a particle concentration of less than about 2 particles per milliliter for particles having a size of about 0.2 microns;

providing a liner inside a rigid container;

collapsing the liner to remove any air in the liner; and filling the collapsed liner with the ultra pure liquid;

wherein collapsing the liner comprises:

pressurizing an intermediate area between the liner and the rigid container to collapse the liner; and venting the liner to allow air inside the liner to exit as the liner is collapsed;

wherein filling the collapsed liner comprises:

supplying the liner with liquid; and venting the intermediate area as the liner fills with liquid.

14. A method of minimizing particle generation in ultra pure liquids during handling of the liquid, the method comprising:

transferring a liquid having an initial particle concentration, from a first location to a second location; and controlling an air-liquid interface during transfer so that a final particle concentration of the liquid when the liquid is in the second location is not substantially greater than the initial particle concentration.

15. The method of claim 14, wherein transferring the liquid from a first location to a second location comprises filling a container from a liquid source using a dip tube.

16. The method of claim 15, wherein controlling the air-liquid interface during filling of the container comprises submerging a tip of the dip tube in the liquid in the container.

17. The method of claim 14, wherein transferring the liquid from a first location to a second location comprises introducing a liquid into a container via a nozzle.

18. The method of claim 17, wherein controlling the air-liquid interface comprises submerging the nozzle in the liquid in the container.

19. The method of claim 14, wherein transferring the liquid from a first location to a second location comprises allowing liquid to overspill a weir from a bath into a sump.

20. The method of claim 19, wherein controlling the air-liquid interface during transfer comprises minimizing an overspill distance between the weir and a surface of liquid located in the sump.

21. The method of claim 14, wherein transferring the liquid from a first location to a second location comprises siphoning liquid from a first container into a second container.

22. The method of claim 21, wherein controlling the air-liquid interface during transfer comprises controlling the siphon to prevent the siphon from breaking its siphoning action.

23. The method of claim 22, wherein controlling the siphon comprises controlling a level of liquid in the first container to prevent the siphon from breaking its siphoning action.

24. The method of claim 14, wherein transferring the liquid from a first location to a second location comprises filling a first container from a liquid source, wherein the first container comprises a liner disposed within a rigid container.

25. The method of claim 24, wherein the liquid in the first container after filling thereof has a particle concentration of less than about 2 particles per milliliter for particles at 0.2 micron size.

26. The method of claim 24, wherein controlling the air-liquid interface comprises:

filling the liner with liquid to less than a maximum capacity so that there is a remaining head space in the liner; and reducing the head space by pressurizing an area between the liner and the rigid container to vent the head space air.

27. The method of claim 14, wherein controlling the air-liquid interface comprises:

filling the container with liquid to less than a maximum capacity so that there is a remaining head space in the container; and reducing the head space by inserting an inert bladder into the head space.

28. The system of claim 27, wherein the means for controlling the air-liquid interface comprises a dip tube having a submerged tip.

29. The system of claim 27, wherein the means for controlling the air-liquid interface comprises a submerged nozzle.

30. The system of claim 27, wherein the means for transferring a liquid comprises a recirculation bath separated from a sump by a weir.

31. The system of claim 30, wherein the means for controlling the air-liquid interface comprises means for reducing a distance between the weir and a level of liquid in the sump.

32. The system of claim 27, wherein the means for controlling the air liquid interface comprises a smart siphon system for controlling the siphon to prevent the siphon from breaking its siphoning action due to entrained air.

33. The system of claim 27, wherein the final particle concentration is less than about 2 particles per milliliter for particles at 0.2 micron size.

34. The system of claim 33, wherein the means for controlling an air-liquid interface comprises:

a container having a rigid outer container and a collapsible inner liner;

means for collapsing the liner to remove any air in the liner;

a liquid source connected to the liner for filling the collapsed liner; and means for venting an intermediate area located between the liner and the rigid outer container as the liner fills with liquid.

35. The system of claim 34, wherein the means for collapsing the liner comprises:

an air source connected to the container to pressurize the intermediate area; and a vent for venting the liner to allow air in the liner to exit as the liner is collapsed.

36. The system of claim 34, further comprising means for dispensing the liquid from the container by pressurizing the intermediate area between the liner and the rigid outer container.

37. The system of claim 27, wherein the means for controlling the air-liquid interface comprises means for reducing head-space in the container after it is filled with liquid.

38. The system of claim 37, wherein the means for reducing head-space comprises an inert bladder.

39. The method of claim 38, wherein the inert bladder is located in the head space.

40. The method of claim 38 wherein the inert bladder is located between the liner and the rigid container.

41. A method of minimizing particle generation in ultra pure liquids during handling of the liquid, the method comprising:

transferring a liquid having an initial particle concentration, from a first location to a second location; and controlling an air-liquid interface during transfer so that a final particle concentration of the liquid when the liquid is in the second location is not substantially greater than the initial particle concentration;

wherein transferring the liquid from a first location to a second location comprises filling a first container from a liquid source, wherein the first container comprises a liner disposed within a rigid container;

wherein the liquid in the first container after filling thereof has a particle concentration of less than about 2 particles per milliliter for particles at 0.2 micron size;

wherein controlling the air-liquid interface comprises:

collapsing the liner to remove air in the liner; and filling the collapsed liner with liquid by supplying the liner with liquid from the liquid source and venting an intermediate area located between the liner and the rigid container as the liner fills with liquid.

42. The method of claim 41, further comprising dispensing the liquid from the first container by pressurizing the intermediate area to dispense the liquid from the liner.

43. The method of claim 42 and wherein dispensing the liquid from the first container further comprises transferring the liquid from the first container to a second container; wherein the second container comprises a liner disposed within a rigid container.

44. The method of claim 43, further comprising:

connecting the liner of the first container to the liner of the second container;

collapsing the liner in the second container to remove air in the liner;

pressurizing the intermediate area of the first container to cause the liquid to move from the liner of the first container to the liner of the second container; and venting an intermediate area located in the second container between the liner and the rigid container, as the liner of the second container is filled with the liquid from the liner of the first container.

45. A method of minimizing particle generation in ultra pure liquids during handling thereof, the method comprising:

providing a liquid;

introducing the liquid to a predetermined location; and controlling an air-liquid interface to control particle level in the liquid.

* * * * *